US008280738B2

(12) United States Patent
Hirose et al.

(10) Patent No.: US 8,280,738 B2
(45) Date of Patent: Oct. 2, 2012

(54) VOICE QUALITY CONVERSION APPARATUS, PITCH CONVERSION APPARATUS, AND VOICE QUALITY CONVERSION METHOD

(75) Inventors: Yoshifumi Hirose, Kyoto (JP); Takahiro Kamai, Kyoto (JP)

(73) Assignee: Panasonic Corporation, Osaka (JP)

( * ) Notice: Subject to any disclaimer, the term of this patent is extended or adjusted under 35 U.S.C. 154(b) by 76 days.

(21) Appl. No.: 13/017,458

(22) Filed: Jan. 31, 2011

(65) Prior Publication Data

US 2011/0125493 A1 May 26, 2011

Related U.S. Application Data

(63) Continuation of application No. PCT/JP2010/004386, filed on Jul. 5, 2010.

(30) Foreign Application Priority Data

Jul. 6, 2009 (JP) ..... 2009-160089

(51) Int. Cl.
*G10L 13/00* (2006.01)
*G10L 13/06* (2006.01)
*G10L 11/00* (2006.01)

(52) U.S. Cl. ..... 704/258; 704/278

(58) Field of Classification Search ..... 704/258–269, 704/278

See application file for complete search history.

(56) References Cited

U.S. PATENT DOCUMENTS 5,847,303 A * 12/1998 Matsumoto ..... 84/610
6,336,092 B1 * 1/2002 Gibson et al. ..... 704/268
6,591,240 B1 * 7/2003 Abe ..... 704/278
6,836,761 B1 * 12/2004 Kawashima et al. ..... 704/258
7,606,709 B2 * 10/2009 Yoshioka et al. ..... 704/258
2005/0049875 A1 3/2005 Kawashima et al.
2007/0208566 A1 * 9/2007 En-Najjary et al. ..... 704/269
2008/0201150 A1 * 8/2008 Tamura et al. ..... 704/266

(Continued)

FOREIGN PATENT DOCUMENTS

JP 8-234790 9/1996

(Continued)

OTHER PUBLICATIONS

International Search Report (in English language) issued Aug. 17, 2010 in the International (PCT) Application No. PCT/JP2010/004386 of which parent U.S. Appl. No. 13/017,458 is the U.S. National Stage.

(Continued)

*Primary Examiner* — Samuel G Neway

(74) *Attorney, Agent, or Firm* — Wenderoth, Lind & Ponack, LLP

(57) ABSTRACT

The voice quality conversion apparatus includes: low-frequency harmonic level calculating units and a harmonic level mixing unit for calculating a low-frequency sound source spectrum by mixing a level of a harmonic of an input sound source waveform and a level of a harmonic of a target sound source waveform at a predetermined conversion ratio for each order of harmonics including fundamental, in a frequency range equal to or lower than a boundary frequency; a high-frequency spectral envelope mixing unit that calculates a high-frequency sound source spectrum by mixing the input sound source spectrum and the target sound source spectrum at the predetermined conversion ratio in a frequency range larger than the boundary frequency; and a spectrum combining unit that combines the low-frequency sound source spectrum with the high-frequency sound source spectrum at the boundary frequency to generate a sound source spectrum for an entire frequency range.

18 Claims, 30 Drawing Sheets

U.S. PATENT DOCUMENTS

| | | | | |
|---|---|---|---|---|
| 2009/0281807 | A1* | 11/2009 | Hirose et al. | 704/254 |
| 2010/0004934 | A1* | 1/2010 | Hirose et al. | 704/261 |

FOREIGN PATENT DOCUMENTS

| | | |
|---|---|---|
| JP | 9-152892 | 6/1997 |
| JP | 2000-10595 | 1/2000 |
| JP | 2000-242287 | 9/2000 |
| JP | 2000-330582 | 11/2000 |
| JP | 2001-117597 | 4/2001 |
| JP | 2001-522471 | 11/2001 |
| JP | 4246792 | 4/2009 |

OTHER PUBLICATIONS

Hideki Banno et al., "*Speech Morphing by Independent Interpolation of Spectral Envelope and Source Excitation*", The Transactions of the Institute of Electronics, Information and Communication Engineers, Feb. 25, 1998, vol. J81-A, No. 2, pp. 261-268.

Takahiro Otsuka et al. "*Robust speech analysis-synthesis method based on the source-filter model and its applications*", IEICE Technical Report, May 18, 2001, SP2001-21, pp. 43-50 with translation.

Takahiro Otsuka et al., "*Robust ARX-based speech analysis method taking voicing source pulse train into account*", The Journal of the Acoustical Society of Japan, Jul. 1, 2002, vol. 58, No. 7, pp. 386-397.

Dennis H. Klatt et al., "*Analysis, synthesis, and perception of voice quality variations among female and male talkers*", Journal of Acoustics Society of America, 87(2), Feb. 1990, pp. 820-857.

F.J. Charpentier et al. "*Diphone Synthesis using an Overlap—Add technique for Speech Waveforms Concatenation*", Proceedings of IEEE International Conference on Acoustic Speech Signal Proceeding, 1986, pp. 2015-2018.

* cited by examiner (a) Sound source spectrum of input speech (b) Sound source spectrum when F0 is converted in PSOLA method (c) Sound source spectrum when F0 is converted according to present invention (a) Sound source spectrum of input speech (b) Sound source spectrum when open quotient is converted according to present invention

VOICE QUALITY CONVERSION APPARATUS, PITCH CONVERSION APPARATUS, AND VOICE QUALITY CONVERSION METHOD

CROSS REFERENCE TO RELATED APPLICATION

This is a continuation application of PCT application No. PCT/JP2010/004386 filed on Jul. 5, 2010, designating the United States of America.

BACKGROUND OF THE INVENTION (1) Field of the Invention

The present invention relates to a voice quality conversion apparatus that converts voice quality of an input speech into another voice quality, and a pitch conversion apparatus that converts a pitch of the input speech into another pitch.

(2) Description of the Related Art

In recent years, the development of speech synthesis technologies has allowed synthesized speeches to have significantly high sound quality.

However, the conventional use of such synthesized speeches is still centered on uniform purposes, such as reading of news texts as news announcers.

Meanwhile, in services of mobile telephones and others, a speech having a distinctive feature has started to be distributed as a content, such as a synthesized speech highly representing a personal speech and a synthesized speech having a distinct prosody and voice quality as the speech style of a high-school girl or a speech with a distinct intonation of the Kansai region in Japan. Thus, in pursuit of further amusement in interpersonal communication, a demand for creating a distinct speech to be heard by the other party is expected to grow.

As one of the conventional speech synthesis methods, what is known is an analysis-synthesis system of synthesizing speech using a parameter by analyzing the speech. In the analysis-synthesis system, a speech signal is separated into a parameter indicating vocal tract information (hereinafter referred to as vocal tract information) and a parameter indicating sound source information (hereinafter referred to as sound source information), by analyzing a speech based on the speech production process. Furthermore, the voice quality of a synthesized speech can be converted into another voice quality by modifying each of the separated parameters in the analysis-synthesis system. Here, a model known as a sound source/vocal tract model is used for the analysis.

In such an analysis-synthesis system, only a speaker feature of an input speech can be converted by synthesizing input text using a small amount of a speech (for example, vowel voices) having target voice quality. Although the input speech generally has natural temporal movement (dynamic feature), the small amount of speech (such as utterance of isolated vowels) having target voice quality does not have much temporal movement. When voice quality is converted using the two kinds of input speeches, it is necessary to convert the voice quality into the speaker feature (static feature) included in the target voice quality while maintaining the temporal movement included in the input speech. In order to support the necessity, Japanese Patent No. 4246792 discloses morphing vocal tract information between an input speech and a speech with target voice quality so that the static feature of the target voice quality is represented while maintaining the dynamic feature of the input speech. When such a conversion is used for converting sound source information, a speech closer to the target voice quality can be generated.

Furthermore, the speech synthesis technologies include a method of generating a sound source waveform representing sound source information, using a sound source model. For example, Rosenberg Klatt model (RK model) is known as the sound source model (see "Analysis, synthesis, and perception of voice quality variations among female and male talkers", Journal of the Acoustics Society of America, 87(2), February 1990, pp. 820-857).

The method is for modeling a sound source waveform in a time domain, and generating a sound source waveform using a parameter representing the modeled waveform. Using the RK model, a sound source feature can be flexibly changed by modifying the parameter.

Equation 1 indicates a sound source waveform (r) modeled in the time domain using the RK model.

$$r(n, \eta) = r_c(nT_s, \eta) \qquad \text{[Equation 1]}$$

$$r_c(nT_s, \eta) = \begin{cases} \dfrac{27AV}{2OQ^2t_0}(t + q_0t_0) - \dfrac{81AV}{4OQ^3t_0^2}(t + OQt_0)^2, & -OQt_0 < t \le 0 \\ 0, \text{ elsewhere} & \end{cases}$$

$$\eta = (AV, t_0, OQ)$$

Here, t denotes a continuous time, $T_s$ denotes a sampling period, and n denotes a discrete time for each $T_s$. Furthermore, AV (abbreviation of Amplitude of Voice) denotes a voiced sound source to amplitude, $t_0$ denotes a fundamental period, and OQ (abbreviation of open quotient) denotes a percentage of time during which a glottis is open with respect to the fundamental period. $\eta$ denotes a set of AV, $t_0$, and OQ.

Since the sound source waveform with a fine structure is represented by a relatively simple model in the RK model, there is an advantage that voice quality can be flexibly changed by modifying a model parameter. However, the fine structure of a sound source spectrum that is a spectrum of an actual sound waveform cannot be sufficiently represented due to the lack of representation capabilities of models. As a result, there is a problem that the sound quality of a synthesized speech lacks natural voice, which will become a very synthetic one.

The present invention is to solve the problems, and has an object of providing a voice quality conversion apparatus and a pitch conversion apparatus each of which can obtain natural voice quality even when a shape of a sound source waveform is changed or the fundamental frequency of a sound source waveform is converted.

SUMMARY OF THE INVENTION

The voice quality conversion apparatus according to an aspect of the present invention is a voice quality conversion apparatus that converts voice quality of an input speech, and includes: a fundamental frequency converting unit configured to calculate a weighted sum of a fundamental frequency of an input sound source waveform and a fundamental frequency of a target sound source waveform at a predetermined conversion ratio as a resulting fundamental frequency, the input sound source waveform representing sound source information of an input speech waveform, and the target sound source waveform representing sound source information of a target speech waveform; a low-frequency spectrum calculating unit configured to calculate a low-frequency sound source spectrum by mixing a level of a harmonic of the input sound source waveform and a level of a harmonic of the target sound source waveform at the predetermined conversion ratio for each order of harmonics including fundamental, using an input sound source spectrum and a target sound source spectrum in a frequency range equal to or lower than a boundary frequency determined depending on the resulting fundamental frequency calculated by the fundamental frequency converting unit, the low-frequency sound source spectrum having levels of harmonics in which the resulting fundamental frequency is set to a fundamental frequency of the low-frequency sound source spectrum, the input sound source spectrum being a sound source spectrum of an input speech, and the target sound source spectrum being a sound source spectrum of a target speech; a high-frequency spectrum calculating unit configured to calculate a high-frequency sound source spectrum by mixing the input sound source spectrum and the target sound source spectrum at the predetermined conversion ratio in a frequency range larger than the boundary frequency; a spectrum combining unit configured to combine the low-frequency sound source spectrum with the high-frequency sound source spectrum at the boundary frequency to generate a sound source spectrum for an entire frequency range; and a synthesis unit configured to generate a synthesized speech waveform using the sound source spectrum for the entire frequency range.

With the configuration, the input sound source spectrum can be transformed by separately controlling each level of harmonics that characterize voice quality in a frequency range equal to or lower than the boundary frequency. Furthermore, the input sound source spectrum can be transformed by changing a shape of a spectral envelope that characterizes the voice quality in a frequency range higher than the boundary frequency. Thus, a synthesized speech with natural voice quality can be generated by transforming voice quality.

Preferably, the input speech waveform and the target speech waveform are speech waveforms of a same phoneme.

Furthermore, it is preferable that the input speech waveform and the target speech waveform are the speech waveforms of the same phoneme and at a same temporal position within the same phoneme.

As such, the input sound source waveform can be smoothly transformed by selecting the target sound source waveform. Thus, the voice quality of an input speech can be converted into natural voice quality.

The pitch conversion apparatus according to another aspect of the present invention is a pitch conversion apparatus that converts a pitch of an input speech, and includes: a sound source spectrum calculating unit configured to calculate an input sound source spectrum that is a sound source spectrum of an input speech, using an input sound source waveform representing sound source information of the input speech; a fundamental frequency calculating unit configured to calculate a fundamental frequency of the input sound source waveform, using the input sound source waveform; a low-frequency spectrum calculating unit configured to calculate a low-frequency sound source spectrum by transforming the input sound source waveform in a frequency range equal to or lower than a boundary frequency determined depending on a predetermined target fundamental frequency so that the fundamental frequency of the input sound source waveform matches the predetermined target fundamental frequency and that levels of harmonics including fundamental before and after the transformation are equal; a spectrum combining unit configured to combine, at the boundary frequency, the low-frequency sound source spectrum with the input sound source spectrum in a frequency range larger than the boundary frequency to generate a sound source spectrum for an entire frequency range; and a synthesis unit configured to generate a synthesized speech waveform using the sound source spectrum for the entire frequency range.

With the configuration, the frequency range of a sound source waveform is divided, and the level of the low-frequency harmonic is set to a position of the harmonic at the target fundamental frequency. Thereby, the open quotient and the spectral tilt that are the features of the sound source and are held by the sound source waveform can be maintained while maintaining the naturalness of the sound source waveform. Thus, the fundamental frequency can be converted without changing features of a sound source.

The voice quality conversion apparatus according to another aspect of the present invention is a voice quality conversion apparatus that converts voice quality of an input speech, and includes: a sound source spectrum calculating unit configured to calculate an input sound source spectrum that is a sound source spectrum of an input speech, using an input sound source waveform representing sound source information of the input speech; a fundamental frequency calculating unit configured to calculate a fundamental frequency of the input sound source waveform, using the input sound source waveform; a level ratio determining unit configured to determine a ratio between a first harmonic level and a second harmonic level that correspond to a predetermined open quotient, with reference to data indicating a relationship between open quotients and ratios of first harmonic levels and second harmonic levels, the first harmonic levels including the first harmonic level, and the second harmonic levels including the second harmonic level; a spectrum generating unit configured to generate a sound source spectrum of a speech by transforming the first harmonic level of the input sound source waveform so that a ratio between the first harmonic level and the second harmonic level of the input sound source waveform that are determined using the fundamental frequency of the input sound source waveform is equal to the ratio determined by the level ratio determining unit; and a synthesis unit configured to generate a synthesized speech waveform using the sound source spectrum generated by the spectrum generating unit.

With the configuration, the open quotient that is a feature of a sound source can be freely changed by controlling the first harmonic level (fundamental) based on a predetermined open quotient, while maintaining the naturalness of the sound source waveform.

The present invention can be implemented as a voice quality conversion apparatus and a pitch conversion apparatus each having characteristic processing units, and as a voice quality conversion method and a pitch conversion method including steps performed by the characteristic processing units of the respective apparatuses. Furthermore, the present invention can be implemented as a program causing a computer to execute the characteristic steps of the voice quality conversion method and the pitch conversion method. The program can be obviously distributed by a recording medium, such as a Compact Disc-Read Only Memory (CD-ROM) or through a communication network, such as the Internet.

The present invention has an object of providing a voice quality conversion apparatus and a pitch conversion apparatus each of which can obtain natural voice quality even when a shape of a sound source spectrum is changed or the fundamental frequency of the sound source spectrum is converted.

FURTHER INFORMATION ABOUT TECHNICAL BACKGROUND TO THIS APPLICATION

The disclosure of Japanese Patent Application No. 2009-160089 filed on Jul. 6, 2009 including specification, drawings and claims is incorporated herein by reference in its entirety.

The disclosure of PCT application No. PCT/JP2010/004386 filed on Jul. 5, 2010, including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENTS

In pursuit of increase in the enjoyment of interpersonal communication, when a distinct speech is produced by changing voice quality, there are cases where speech conversion across gender, for example, from a speech of a male speaker to that of a female speaker and vice versa, is desired. Furthermore, there are cases where a degree of tension in a speech is desirably changed.

Based on the speech production process, the sound source waveform of a speech is produced by opening and closing of vocal folds. Thus, voice quality is different according to a physiological state of the vocal folds. For example, when the degree of tension of the vocal folds increases, the vocal folds close. Thus, as illustrated in (a) in FIG. 1, a peak of the differential sound source waveform obtained by differentiating a sound source waveform becomes shaper, and the differential sound source waveform approximates an impulse. In other words, a glottal closure interval 30 becomes shorter. In contrast, it is known that when the degree of tension of the vocal folds decreases, the vocal folds do not completely close, the differential sound source waveform gradually declines from its peak and then approximates a sinusoidal waveform as illustrated in (c) in FIG. 1. In other words, the glottal closure interval 30 becomes longer. (b) in FIG. 1 illustrates a sound source waveform, a differential sound source waveform, and a sound source spectrum in the case of an intermediate degree of tension between (a) and (c) in FIG. 1.

Figure 1:
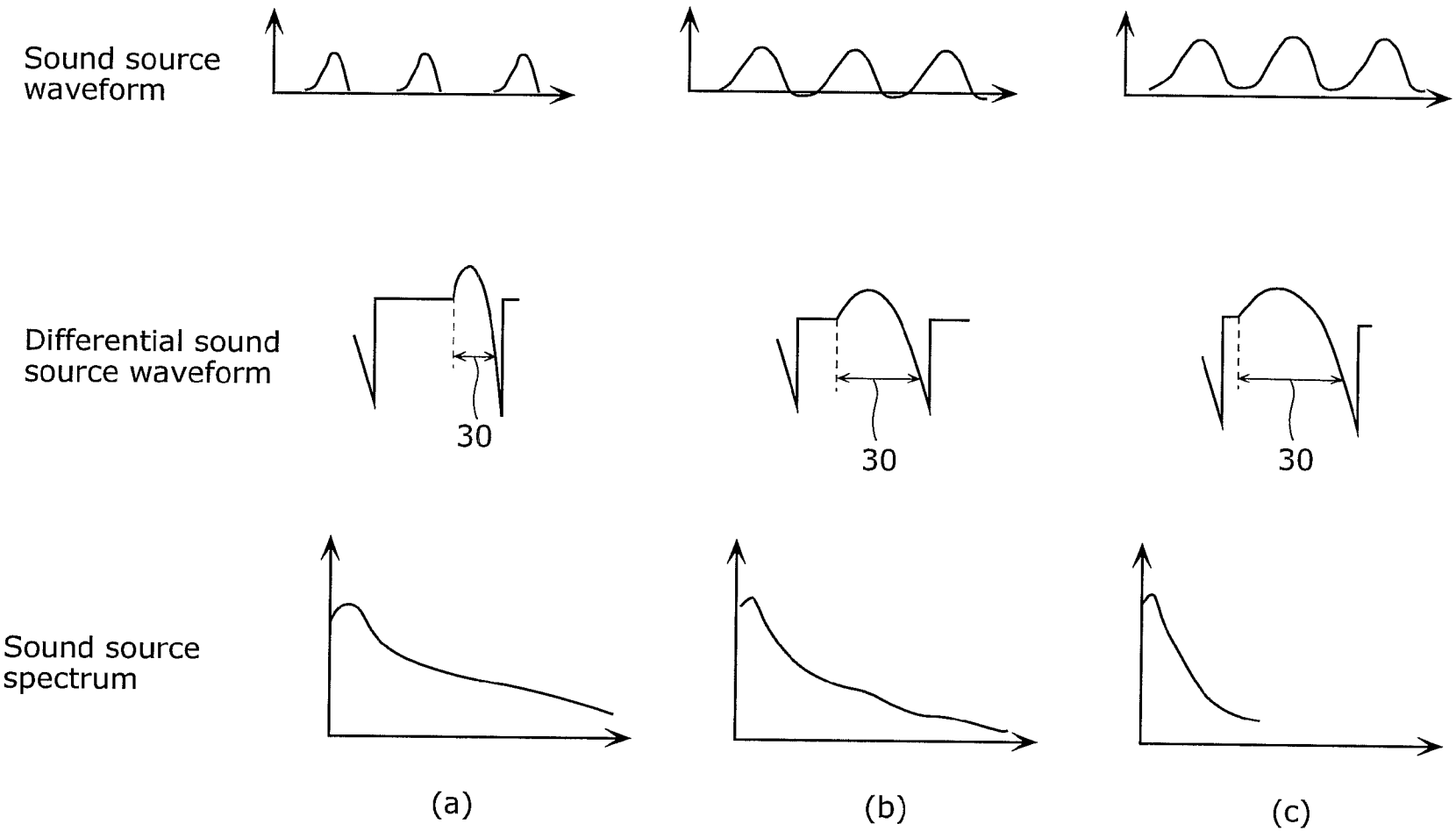
FIG. 1 illustrates differences among sound source waveforms, differential sound source waveforms, and sound source spectrums, depending on vocal fold states.

Using the RK model, the sound source waveform as illustrated in (a) in FIG. 1 can be generated with a lower open quotient (OQ), and the sound source waveform as illustrated in (c) in FIG. 1 can be generated with a higher OQ. Furthermore, setting an OQ to an intermediate quotient (for example, 0.6) enables generation of the sound source waveform as illustrated in (b) in FIG. 1.

As such, voice quality can be changed by modeling a sound source waveform, representing the modeled waveform by a parameter, and modifying the parameter. For example, a state where a degree of tension of vocal folds is lower can be represented by increase in an OQ parameter. In addition, a state where a degree of tension of vocal folds is higher can be represented by decrease in an OQ parameter. However, since the RK model is a simple model, the fine spectrum structure held in an original sound source can not be represented.

The following will describe a voice quality conversion apparatus that can convert voice quality of an input speech into more flexible and higher sound quality, by changing a sound source feature while maintaining the fine structure of the sound source.

Embodiment 1

Figure 2:
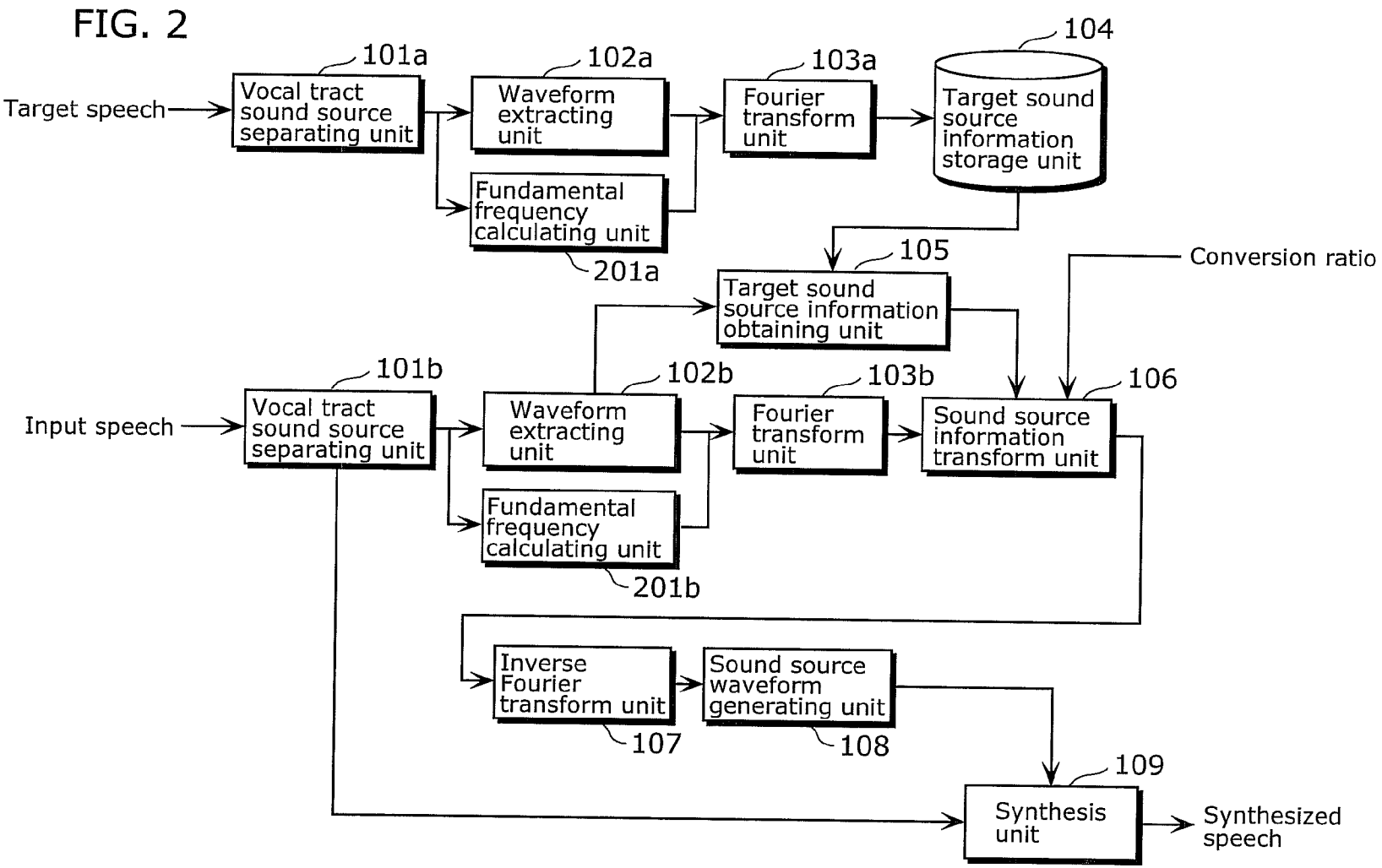
FIG. 2 is a functional block diagram illustrating a configuration of a voice quality conversion apparatus according to Embodiment 1 in the present invention.

FIG. 2 is a functional block diagram illustrating a configuration of a voice quality conversion apparatus according to Embodiment 1 in the present invention.

(Overall Configuration)

The voice quality conversion apparatus converts voice quality of an input speech into voice quality of a target speech at a predetermined conversion ratio, and includes a vocal tract sound source separating unit 101*a*, a waveform extracting unit 102*a*, a fundamental frequency calculating unit 201*a*, a Fourier transform unit 103*a*, a target sound source information storage unit 104, a vocal tract sound source separating unit 101*b*, a waveform extracting unit 102*b*, a fundamental frequency calculating unit 201*b*, and a Fourier transform unit 103*b*. Furthermore, the voice quality conversion apparatus includes a target sound source information obtaining unit 105, a sound source information transform unit 106, an inverse Fourier transform unit 107, a sound source waveform generating unit 108, and a synthesis unit 109.

The vocal tract sound source separating unit 101*a* analyzes a target speech waveform that is a speech waveform of a target speech and separates the target speech waveform into vocal tract information and sound source information.

The waveform extracting unit 102*a* extracts a waveform from a sound source waveform representing the sound source information separated by the vocal tract sound source separating unit 101*a*. The method of extracting the waveform will be described later.

The fundamental frequency calculating unit 201*a* calculates a fundamental frequency of the sound source waveform extracted by the waveform extracting unit 102*a*.

The Fourier transform unit 103*a* Fourier-transforms the sound source waveform extracted by the waveform extracting unit 102*a* into a sound source spectrum of a target speech (hereinafter referred to as a target sound source spectrum). The Fourier transform unit 103*a* corresponds to a sound source spectrum calculating unit according to an aspect of the present invention. The method of transforming a frequency is not limited to the Fourier transform, but may be other methods, such as a discrete Fourier transform and a wavelet transform.

The target sound source information storage unit 104 is a storage unit that holds the target sound source spectrum generated by the Fourier transform unit 103*a*, and more specifically includes a hard disk drive. The target sound source information storage unit 104 holds the fundamental frequency of the sound source waveform calculated by the fundamental frequency calculating unit 201*a* as well as the target sound source spectrum.

The vocal tract sound source separating unit 101*b* separates an input speech waveform that is a speech waveform of an input speech, into vocal tract information and sound source information by analyzing the input speech waveform.

The waveform extracting unit 102*b* extracts a waveform from a sound source waveform representing the sound source information separated by the vocal tract sound source separating unit 101*b*. The method of extracting the waveform will be described later.

The fundamental frequency calculating unit 201*b* calculates a fundamental frequency of the sound source waveform extracted by the waveform extracting unit 102*b*.

The Fourier transform unit 103*b* Fourier-transforms the sound source waveform extracted by the waveform extracting unit 102*b* into a sound source spectrum of the input speech (hereinafter referred to as an input sound source spectrum). The Fourier transform unit 103*a* corresponds to a sound source spectrum calculating unit according to an aspect of the present invention. The method of transforming a frequency is not limited to the Fourier transform, but may be other methods, such as a discrete cosine transform and a wavelet transform.

The target sound source information obtaining unit 105 obtains, from the target sound source information storage unit 104, the target sound source spectrum corresponding to the sound source waveform of the input speech (hereinafter referred to as input sound source waveform) extracted by the waveform extracting unit 102*b*. For example, the target sound source information obtaining unit 105 obtains a target sound source spectrum generated from a sound source waveform of the target speech (hereinafter referred to as target sound source waveform) having the same phoneme as that of the input sound source waveform. More preferably, the target sound source information obtaining unit 105 obtains a target sound source spectrum generated from the target sound source waveform that has the same phoneme and is at the same temporal position within the phoneme as that of the input sound source waveform. Furthermore, the target sound source information obtaining unit 105 obtains, as well as the target sound source spectrum, the fundamental frequency of the target sound source waveform corresponding to the target sound source spectrum. As such, the voice quality of the input speech can be converted into natural voice quality by selecting the target sound source waveform in converting the input sound source waveform.

The sound source information transform unit 106 transforms the input sound source spectrum into the target sound source spectrum obtained by the target sound source information obtaining unit 105, at a predetermined conversion ratio.

The inverse Fourier transform unit 107 inverse-Fourier-transforms the sound source spectrum transformed by the sound source information transform unit 106 to generate one cycle of a waveform in a time domain (hereinafter referred to as "time waveform"). The method of inversely transforming a frequency is not limited to the inverse Fourier transform, but may be other methods, such as an inverse discrete cosine transform and an inverse wavelet transform.

The sound source waveform generating unit 108 generates a sound source waveform by setting the time waveform generated by the inverse Fourier transform unit 107 to a position with respect to the fundamental frequency. The sound source waveform generating unit 108 repeats the process for each fundamental period to generate sound source waveforms.

The synthesis unit 109 synthesizes the vocal tract information separated by the vocal tract sound source separating unit 101*b* and the sound source waveform generated by the sound source waveform generating unit 108 to generate a synthesized speech waveform. The inverse Fourier transform unit 107, the sound source waveform generating unit 108, and the synthesis unit 109 correspond to a synthesis unit according to an aspect of the present invention.

(Detailed Configuration)

Figure 3:
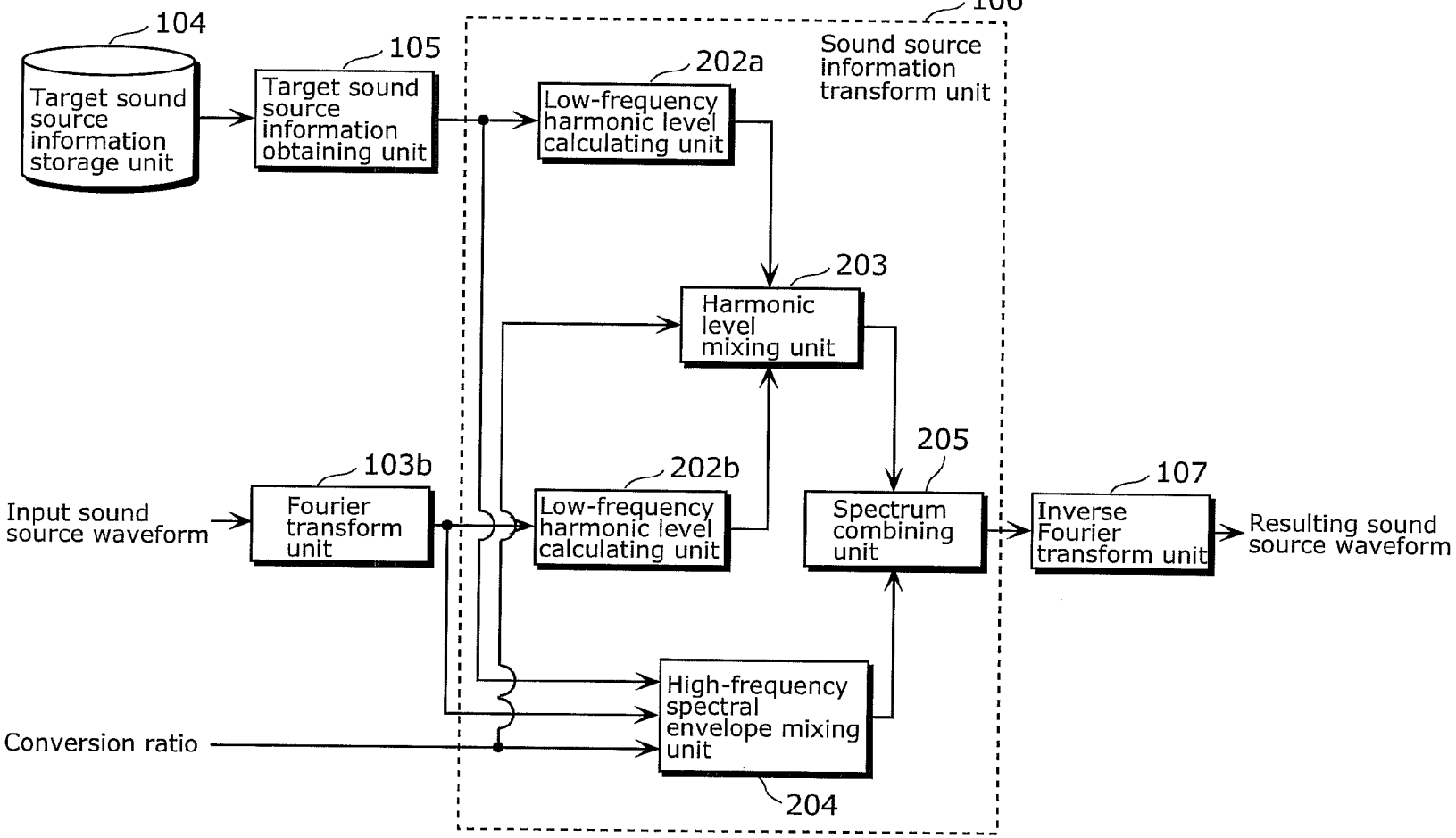
FIG. 3 is a block diagram illustrating a detailed functional configuration of a sound source information transform unit.

FIG. 3 is a block diagram illustrating a detailed functional configuration of the sound source information transform unit 106.

In FIG. 3, the description of the same configuration as that of FIG. 2 will be omitted.

The sound source information transform unit 106 includes a low-frequency harmonic level calculating unit 202*a*, a low-frequency harmonic level calculating unit 202*b*, a harmonic level mixing unit 203, a high-frequency spectral envelope mixing unit 204, and a spectrum combining unit 205.

The low-frequency harmonic level calculating unit 202*a* calculates levels of harmonics of an input sound source waveform using the fundamental frequency of the input sound source waveform and the input sound source spectrum. Here, each of the levels of harmonics indicates a spectral intensity at a frequency of an integer multiple of the fundamental frequency in a sound source spectrum. The harmonics include fundamental in Specification and Claims.

The low-frequency harmonic level calculating unit 202*b* calculates levels of harmonics of a target sound source waveform, using the fundamental frequency of the target sound source waveform and the target sound source spectrum that are obtained by the target sound source information obtaining unit 105.

The harmonic level mixing unit 203 mixes the levels of the harmonic of the input sound source waveform calculated by the low-frequency harmonic level calculating unit 202*b* and the levels of the harmonic of the target sound source waveform calculated by the low-frequency harmonic level calculating unit 202*a*, respectively, at a predetermined conversion ratio r provided from outside of the voice quality conversion apparatus to generate levels of the harmonics. Furthermore, the harmonic level mixing unit 203 mixes the fundamental frequency of the input sound source waveform and the fundamental frequency of the target sound source waveform at the predetermined conversion ratio r to generate a resulting fundamental frequency. Furthermore, the harmonic level mixing unit 203 sets the resulting level of the harmonics to the frequency of the harmonics calculated using the resulting fundamental frequency to calculate a resulting sound source spectrum. The harmonic level mixing unit 203 corresponds to a fundamental frequency converting unit and a low-frequency spectrum calculating unit according to an aspect of the present invention.

The high-frequency spectral envelope mixing unit 204 mixes the input sound source spectrum and the target sound source spectrum at the conversion ration r in a frequency range higher than a boundary frequency to calculate a high-frequency sound source spectrum. The high-frequency spectral envelope mixing unit 204 corresponds to a high-frequency spectrum calculating unit according to an aspect of the present invention.

The spectrum combining unit 205 combines, at the boundary frequency, the sound source spectrum calculated by the harmonic level mixing unit 203 in a frequency range equal to or lower than the boundary frequency with the high-frequency sound source spectrum calculated by the high-frequency spectral envelope mixing unit 204 in a frequency range higher than the boundary frequency to generate a sound source spectrum for the entire frequency range.

As described above, mixing the sound source spectrums in the low frequency range and the sound source spectrums in the high frequency range results in sound source spectrums in which the voice quality characteristics of the sound source are mixed at the conversion ration r.

(Description of Operations)

Next, the operations performed by the voice quality conversion apparatus according to Embodiment 1 in the present invention will be described using a flowchart.

The processes performed by the voice quality conversion apparatus are divided into processes of obtaining a sound source spectrum from an input speech waveform and processes of transforming the input speech waveform with transformation of the sound source spectrum. The former processes will be described first, and then the latter processes will be described next.

Figure 4:
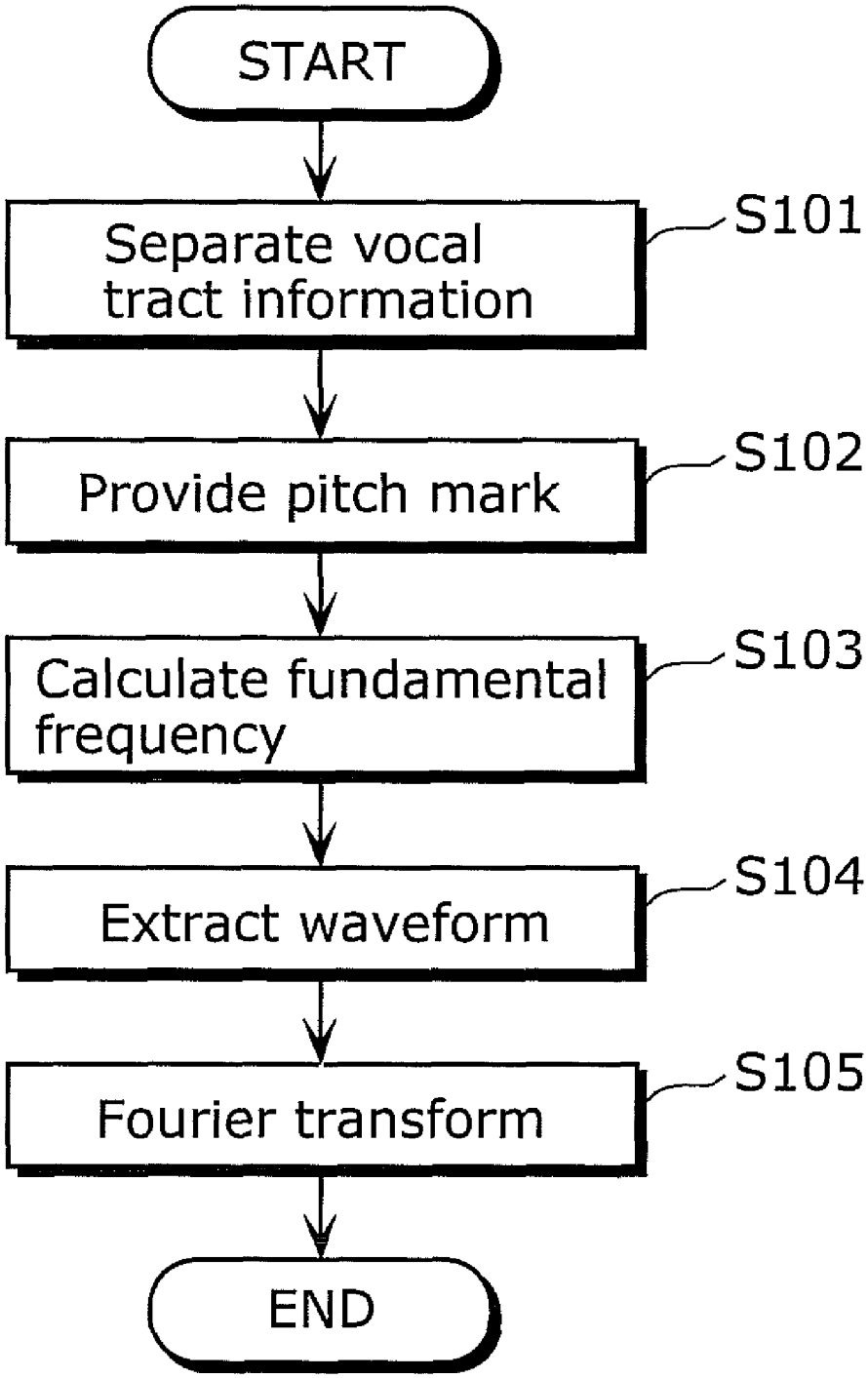
FIG. 4 illustrates a flowchart for obtaining a spectral envelope of a sound source from an input speech waveform according to Embodiment 1 in the present invention.

FIG. 4 illustrates the flowchart for obtaining a sound source spectral envelope from an input speech waveform.

The vocal tract sound source separating unit 101*a* separates a target speech waveform into vocal tract information and sound source information. Furthermore, the vocal tract sound source separating unit 101*b* separates an input speech waveform into vocal tract information and sound source information (Step S101). The separating method is not limited to a particular method. For example, a sound source model is assumed, and vocal tract information is analyzed using autoregressive with exogenous input (ARX analysis) that enables simultaneous estimation of the vocal tract information and sound source information. Furthermore, as disclosed in "Robust ARX-based speech analysis method taking voicing source pulse train into account", the Journal of the Acoustical Society of Japan 58(7), 2002, pages 386 to 397, a filter having characteristics opposite to those of a vocal tract may be configured from analyzed vocal tract information, and an inverse filter sound source waveform may be extracted from an input speech signal to be used as sound source information. Here, Linear Predictive Coding (LPC analysis) may be used instead of the ARX analysis. Furthermore, vocal tract information and sound source information may be separated through other analysis.

Figure 5:
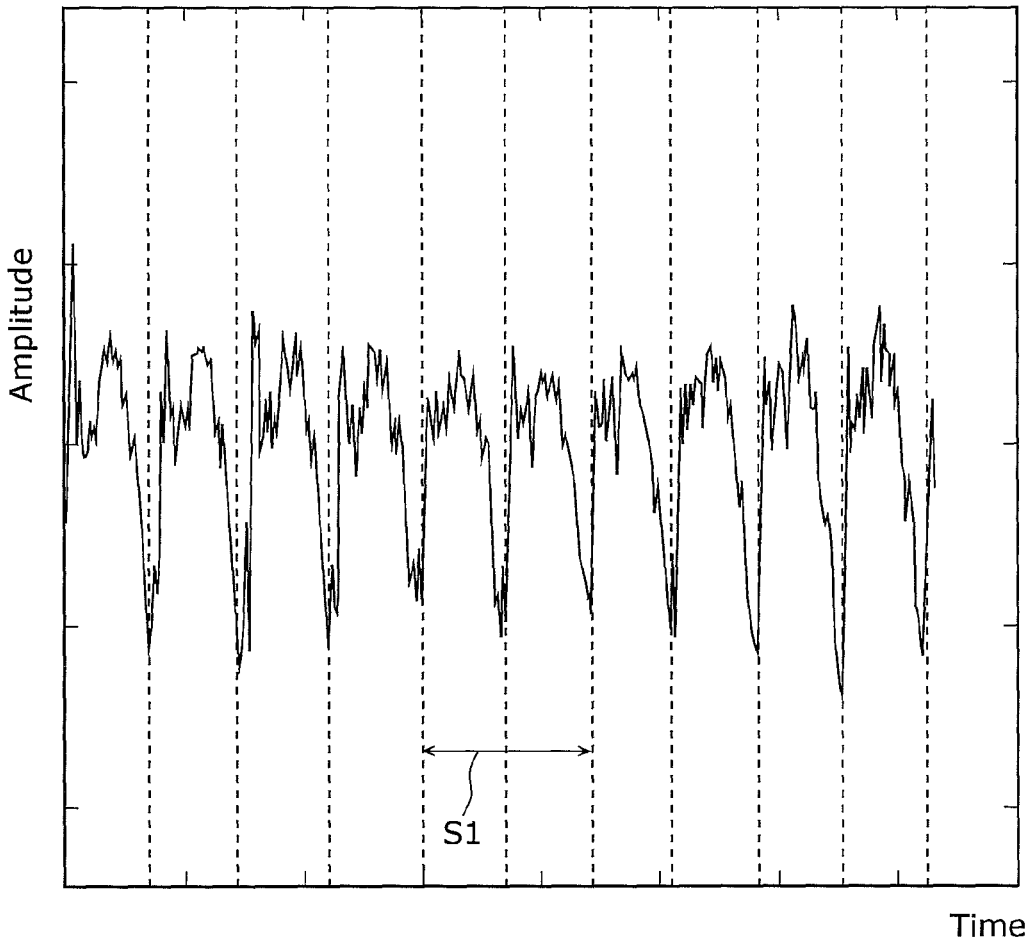
FIG. 5 illustrates a graph of a sound source waveform to which pitch marks are provided.

The waveform extracting unit 102*a* provides a pitch mark to a target sound source waveform representing sound source information of the target speech waveform separated at Step S101. Furthermore, the waveform extracting unit 102*b* provides a pitch mark to an input sound source waveform representing sound source information of the input speech waveform separated at Step S101 (Step S102). More specifically, each of the waveform extracting units 102*a* and 102*b* provides a feature point to a sound source waveform (target sound source waveform or input sound source waveform) for each fundamental period. For example, a glottal closure instant (GCI) is used as the feature point. The feature points are not limited to such. As long as the feature points are points that repeatedly appear at fundamental period intervals, any feature points may be used. FIG. 5 illustrates a graph of a sound source waveform to which pitch marks are provided using the GCIs. The horizontal axis indicates the time, and the vertical axis indicates the amplitude. Furthermore, each dashed line indicates a position of the pitch mark. In the graph of the sound source waveform, the minimum of the amplitude coincides with the GCI. The feature point may be at a peak position (local maximum point) of an amplitude of a speech waveform.

The fundamental frequency calculating unit 201*a* calculates a fundamental frequency of the target sound source waveform. The fundamental frequency calculating unit 201*b* calculates a fundamental frequency of the input sound source waveform (Step S103). The method of calculating the fundamental frequency is not limited to a particular method. For example, the fundamental frequency may be calculated using the intervals between the pitch marks provided at Step S102. Since the intervals between the pitch marks are equivalent to the fundamental periods, the fundamental frequency can be calculated by calculating the inverse of the fundamental period. Alternatively, the fundamental frequencies of an input sound source waveform and a target sound source waveform may be calculated using methods of calculating fundamental frequencies, such as the auto-correlation method.

The waveform extracting unit 102*a* extracts two cycles of a target sound source waveform, from the target sound source waveform. Furthermore, the waveform extracting unit 102*b* extracts two cycles of an input sound source waveform, from the input sound source waveform (Step S104). More specifically, the waveform extracting units 102*a* and 102*b* extract sound source waveforms for the fundamental periods corresponding to the fundamental frequencies previously and subsequently calculated by the fundamental frequency calculating units 201*a* and 201*b*, respectively, with respect to a target pitch mark. In other words, a section 51 of the sound source waveform is extracted in the graph of FIG. 5.

Figure 6:
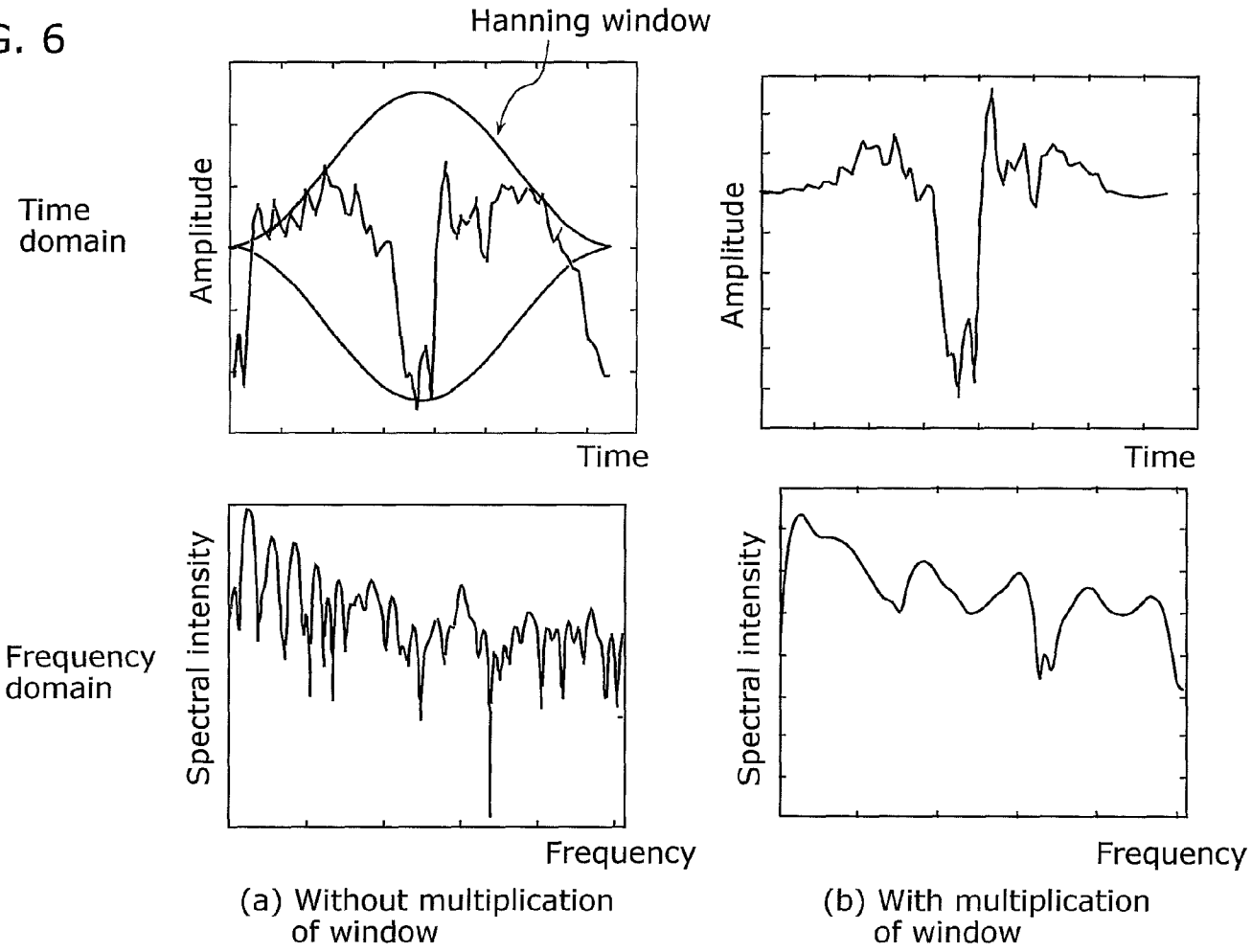
FIG. 6 illustrates examples of sound source waveforms extracted by a waveform extracting unit and sound source spectrums transformed by a Fourier-transform unit.

The Fourier transform unit 103*a* Fourier-transforms the target sound source waveform extracted at Step S104 into a target sound source spectrum. Furthermore, the Fourier transform unit 103*b* Fourier-transforms the input source waveform extracted at Step S104 into an input sound source spectrum (Step S105). Here, the extracted sound source waveform is multiplied by the Hanning window of the length double the fundamental frequency of the extracted sound source waveform, resulting in the smoothness in the valley of the harmonic component and obtainment of a spectral envelope of the sound source spectrum. The operation can eliminate the influence on the fundamental frequency. (a) in FIG. 6 illustrates an example of a sound source waveform (time domain) and the sound source spectrum (frequency domain) when the Hanning window is not multiplied. (b) in FIG. 6 illustrates an example of a sound source waveform (time domain) and the sound source spectrum (frequency domain) when the Hanning window is multiplied. As such, the spectral envelope of the sound source spectrum can be obtained by multiplying the Hanning window. The window function is not limited to the Hanning window, and other window functions may be used, such as the Hamming window and the Gaussian window.

With the processes from Steps S101 to S105, the input sound source spectrum and the target sound source spectrum are calculated using the input speech source waveform and the target speech waveform, respectively.

Next, processes of converting an input sound source waveform will be described.

Figure 7:
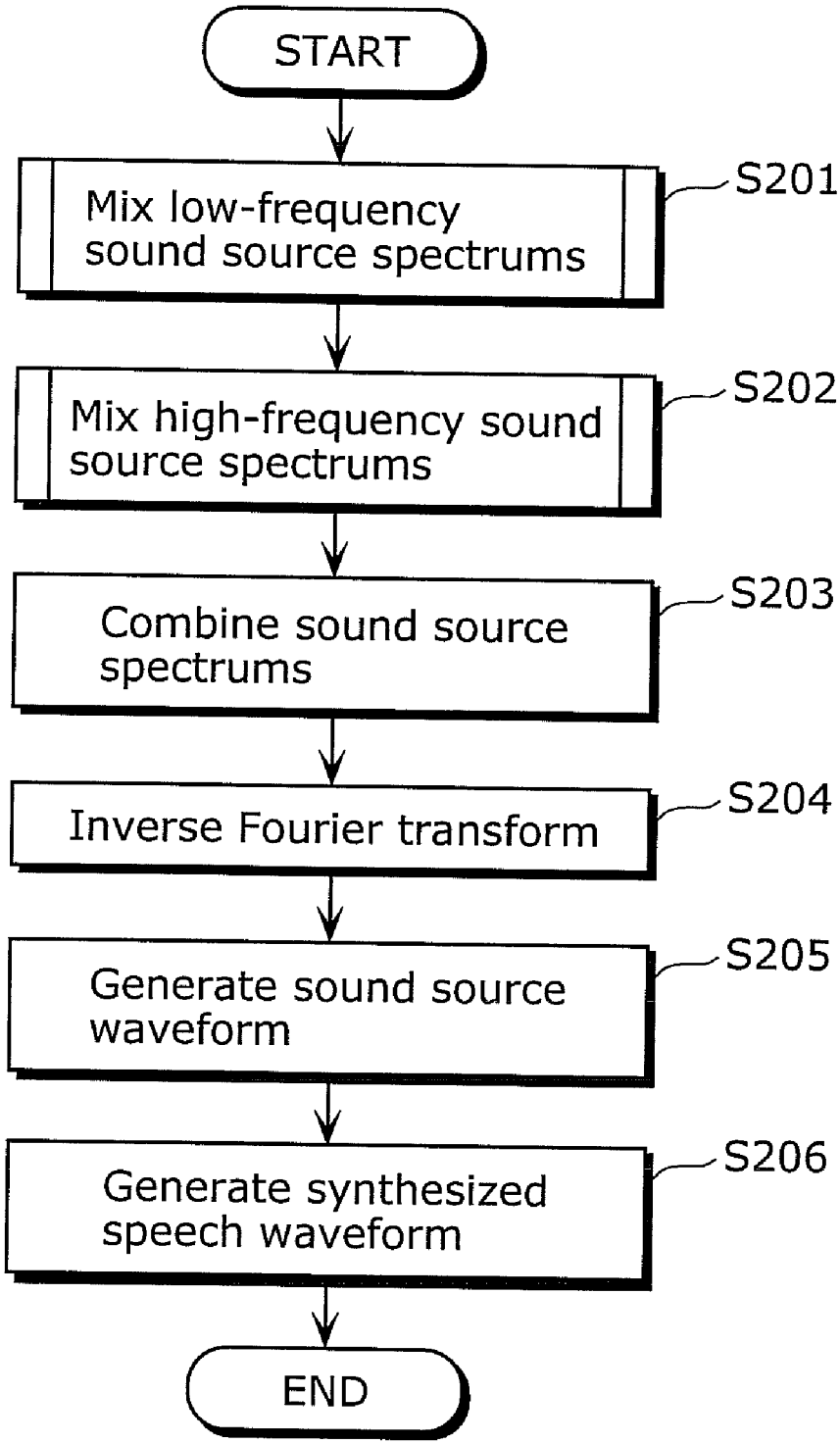
FIG. 7 illustrates a flowchart of processes of converting an input sound source waveform using an input sound source spectrum and a target sound source spectrum according to Embodiment 1 in the present invention.

FIG. 7 illustrates a flowchart of the processes of converting an input sound source waveform using an input sound source spectrum and a target sound source spectrum.

The low-frequency harmonic level calculating unit 202*a*, the low-frequency harmonic level calculating unit 202*b*, and the harmonic level mixing unit 203 mix an input sound source spectrum and a target sound source spectrum in a frequency range equal to or lower than the boundary frequency (Fb) to be described later to generate a low-frequency sound source spectrum having a resulting speech waveform (Step S201). The mixing method will be described later.

The high-frequency spectral envelope mixing unit 204 mixes the input sound source spectrum and the target sound source spectrum in a frequency range higher than the boundary frequency (Fb) to generate a high-frequency sound source spectrum having a resulting speech waveform (Step S202). The mixing method will be described later.

The spectrum combining unit 205 combines the low-frequency sound source spectrum generated at Step S201 with the high-frequency sound source spectrum generated at Step S202 at the boundary frequency (Fb) to generate a sound source spectrum for the entire frequency range (Step S203). More specifically, in the sound source spectrum for the entire frequency range, the low-frequency sound source spectrum generated at Step S201 is used in the frequency range equal to or lower than the boundary frequency (Fb), and the high-frequency sound source spectrum generated at Step S202 is used in the frequency range higher than the boundary frequency (Fb).

Here, the boundary frequency (Fb) is determined in the following method using the fundamental frequency after conversion to be described later, for example.

Figure 8:
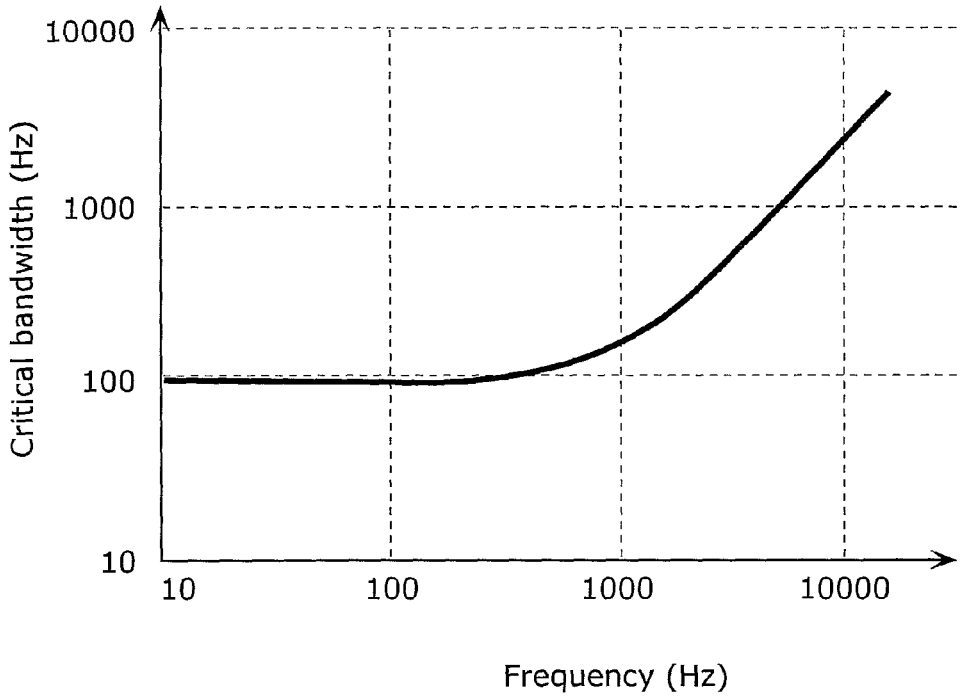
FIG. 8 is a graph indicating the critical bandwidth for each frequency.

FIG. 8 is a graph indicating the critical bandwidth that is one of the auditory properties. The horizontal axis indicates the frequency, and the vertical axis indicates the critical bandwidth.

The critical bandwidth is a frequency range contributing to masking the pure tone at the frequency. In other words, two sounds included in the critical bandwidth at a certain frequency (two sounds in which an absolute value of a difference between the frequencies is equal to or lower than the critical bandwidth) are added to each other, and the resulting sound is perceived as louder sound. In contrast, two sounds at an interval longer than the critical bandwidth (two sounds in which an absolute value of a difference between the frequencies is higher than the critical bandwidth) are perceived as different sounds, and are not perceived as louder sound. For example, the pure tone at 100 Hz has the critical bandwidth of 100 Hz. Thus, when a sound (for example, a sound at 150 Hz) within the 100 Hz region with respect to the pure sound is added to the pure tone, the pure tone at 100 Hz is seemingly perceived as louder sound.

Figure 9:
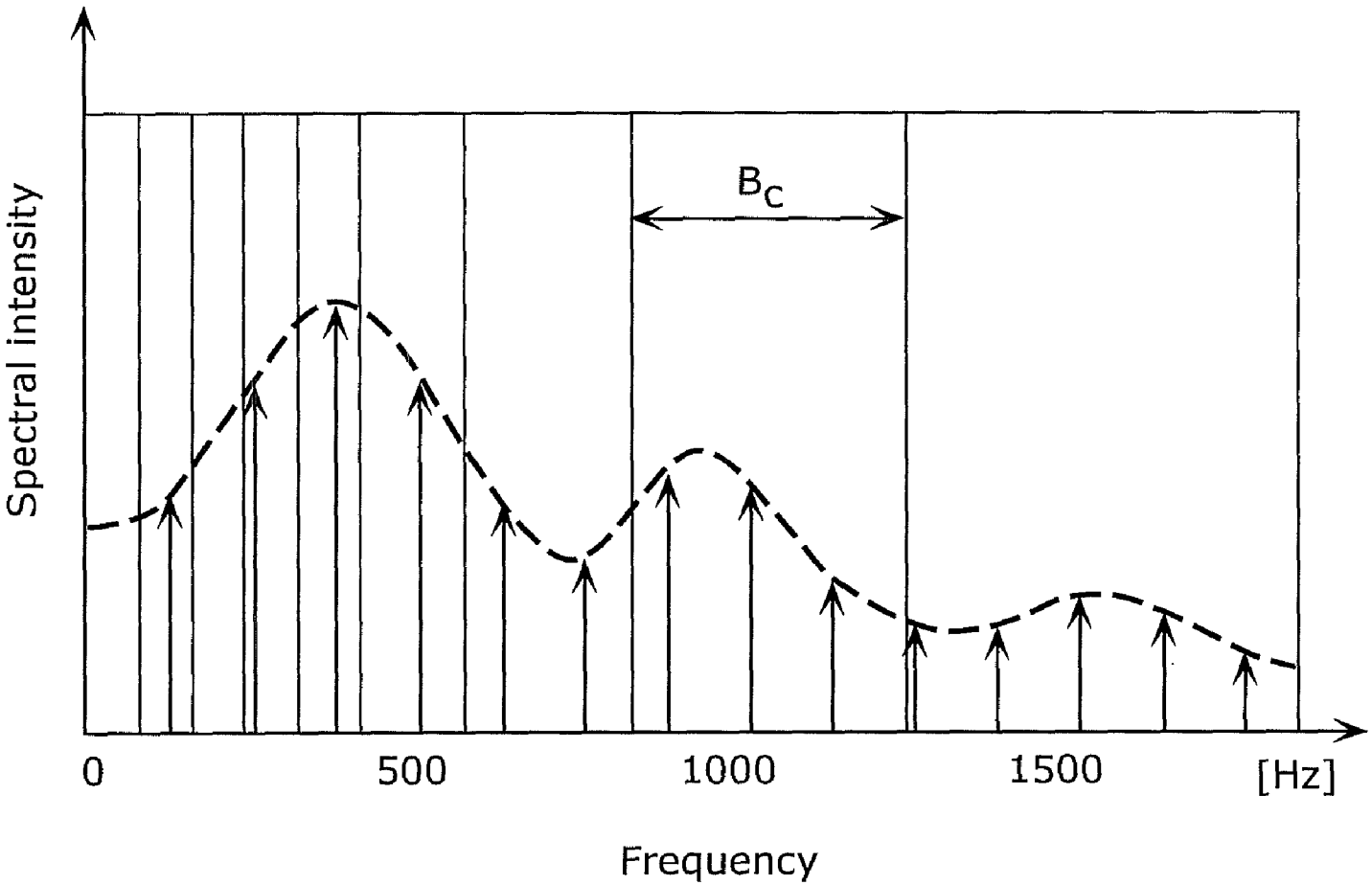
FIG. 9 illustrates a difference between critical bandwidths for each frequency.

FIG. 9 schematically illustrates the critical bandwidths. The horizontal axis indicates the frequency, and the vertical axis indicates the spectral intensity of a sound source spectrum. Furthermore, each up-pointing arrow indicates the harmonic, and the dashed line indicates a spectral envelope of the sound source spectrum. Then, each of the horizontally-aligned rectangles represents the critical bandwidth in a frequency range. The section Bc in the graph shows the critical bandwidth in a frequency range. Each rectangle in the frequency range higher than 500 Hz in the graph includes a plurality of harmonics. However, a single rectangle in the frequency range equal to lower than 500 Hz includes only one harmonic.

The plurality of harmonics within one rectangle is in a relationship in which the same sound volume is added to the harmonics, and the harmonics are perceived as a mass. In contrast, each of the harmonics has the property to be perceived as a different sound when they are in the separate rectangles. As such, the harmonics in a frequency range higher than a certain frequency are perceived as the mass, while each of the harmonics is separately perceived in a frequency range equal to or lower than a certain frequency.

In the frequency range where each of the harmonics is not separately perceived, as long as the spectral envelope can be represented, the sound quality can be maintained. Thus, it is possible to assume that the shape of spectral envelope in the frequency range can characterize the voice quality (sound quality). In contrast, each level of harmonics needs to be controlled in a frequency range where each of the harmonics is separately perceived. Thus, it is possible to assume that each level of the harmonics in the frequency range can characterize the voice quality. The frequency interval of the harmonics is equal to the value of the fundamental frequency. Thus, the boundary frequency between the frequency range where each of the harmonics is not separately perceived and the frequency range where each of the harmonics is separately perceived is a frequency (frequency derived from the graph of FIG. 8) corresponding to the critical bandwidth matching the value of the fundamental frequency after conversion.

Using the human auditory properties, the frequency corresponding to the critical bandwidth matching the value of the fundamental frequency after conversion is determined as the boundary frequency (Fb). In other words, the fundamental frequency can be associated with the boundary frequency. The spectrum combining unit 205 combines, at the boundary frequency (Fb), the low-frequency sound source spectrum generated by the harmonic level mixing unit 203 with the high-frequency sound source spectrum generated by the high-frequency spectral envelope mixing unit 204.

For example, the harmonic level mixing unit 203 may hold, in advance, the characteristics of the critical bandwidth as illustrated in FIG. 8 as a data table, and determine the boundary frequency (Fb) using the fundamental frequency. Furthermore, the harmonic level mixing unit 203 has only to provide the determined boundary frequency (Fb) to the high-frequency spectral envelope mixing unit 204 and the spectrum combining unit 205.

The rule data for determining the boundary frequency from the fundamental frequency is not limited to the data table indicating the relationship between the frequency and the critical bandwidth as illustrated in FIG. 8. For example, the rule data may include a function representing the relationship between the fundamental frequency and the critical bandwidth. Furthermore, the rule data may be the data table or the function indicating the relationship between the fundamental frequency and the critical bandwidth.

Figure 10:
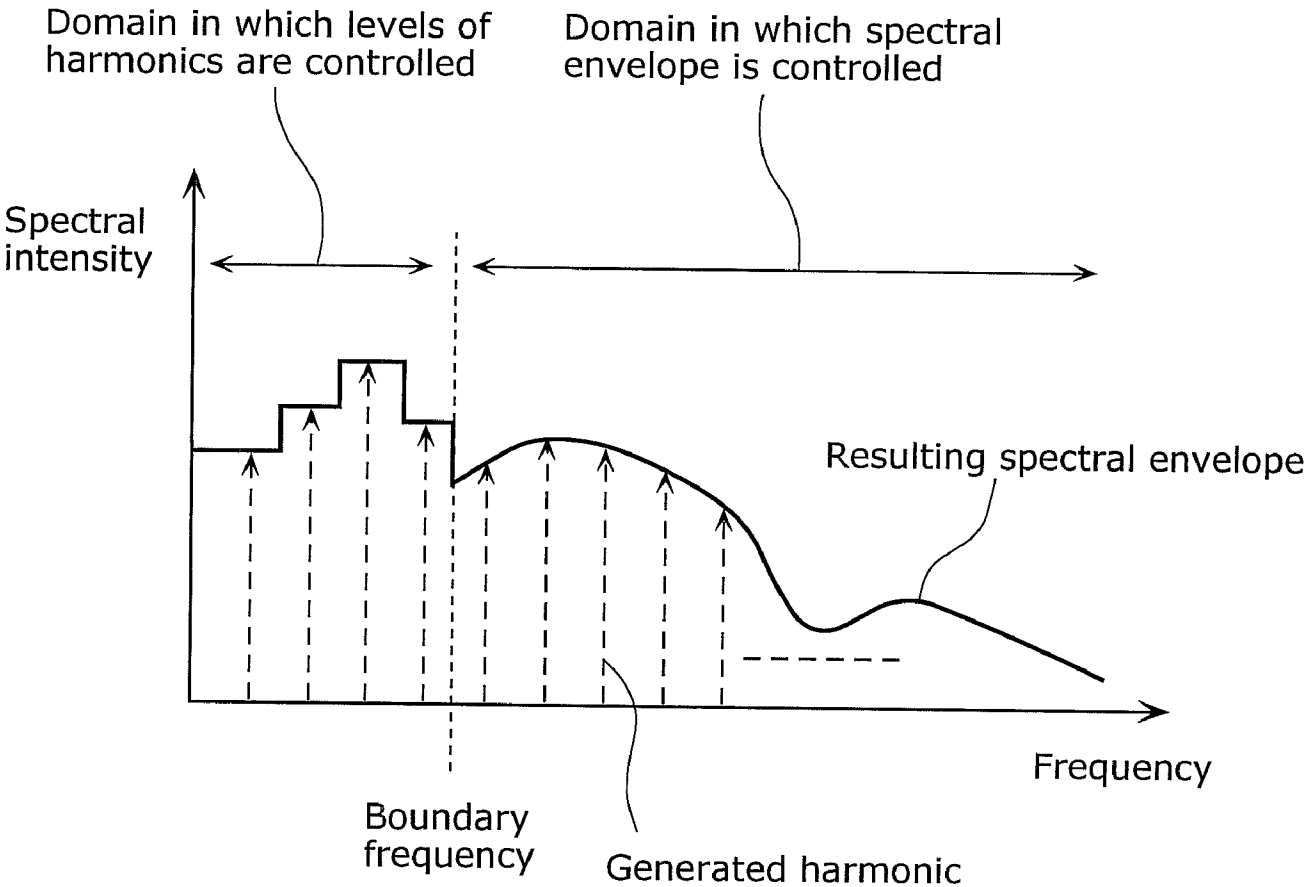
FIG. 10 illustrates combining of sound source spectrums in a critical bandwidth.

The spectrum combining unit 205 may combine the low-frequency sound source spectrum and the high-frequency sound source spectrum approximately at the boundary frequency (Fb). FIG. 10 illustrates an example of the sound source spectrum of the entire frequency range after the combining. The solid line indicates the spectral envelope of the sound source spectrum of the entire frequency range after the combining. Furthermore, FIG. 10 illustrates the spectral envelope and up-pointing dashed arrows representing the resulting harmonics generated by the sound source waveform generating unit 108. As illustrated in FIG. 10, the spectral envelope has a smooth shape in a frequency range higher than the boundary frequency (Fb). However, the spectral envelope is sufficient as the stepwise spectral envelope as illustrated in FIG. 10 because the levels of harmonics have only to be controlled in the frequency range equal to or lower than the boundary frequency (Fb). The shape of the envelope to be generated may be any shape as long as the levels of harmonics can be accurately controlled in the outcome.

With reference to FIG. 7 again, the inverse Fourier transform unit 107 inverse-Fourier-transforms the sound source spectrum obtained at Step S203 to represent the sound source spectrum in a time domain, and generates one cycle of a time waveform (Step S204).

The sound source waveform generating unit 108 sets one cycle of the time waveform generated at Step S204 to the position of a fundamental period calculated using a fundamental frequency calculated by the sound source information transform unit 106. With the setting process, one cycle of the sound source waveform is generated. With the repetition of the setting process for each fundamental period, the sound source waveform corresponding to the input speech waveform can be generated (Step S205).

The synthesis unit 109 synthesizes the vocal tract information separated by the vocal tract sound source separating unit 101*b* and the sound source waveform generated by the sound source waveform generating unit 108 to generate a synthesized speech waveform (Step S206). The synthesis method is not limited to a particular method, but when Partial Auto Correlation (PARCOR) coefficients are used as vocal tract information, the PARCOR coefficients may be synthesized. Furthermore, after transforming a speech waveform to LPC coefficients mathematically equivalent to the PARCOR coefficients, the LPC coefficients may be synthesized. Alternatively, formants may be extracted from the LPC coefficients, and the extracted formants may be synthesized. Furthermore, Line Spectrum Pair (LSP) coefficients may be calculating using the LPC coefficients, and the LSP coefficients may be synthesized.

(Low-Frequency Mixing Process)

Figure 11:
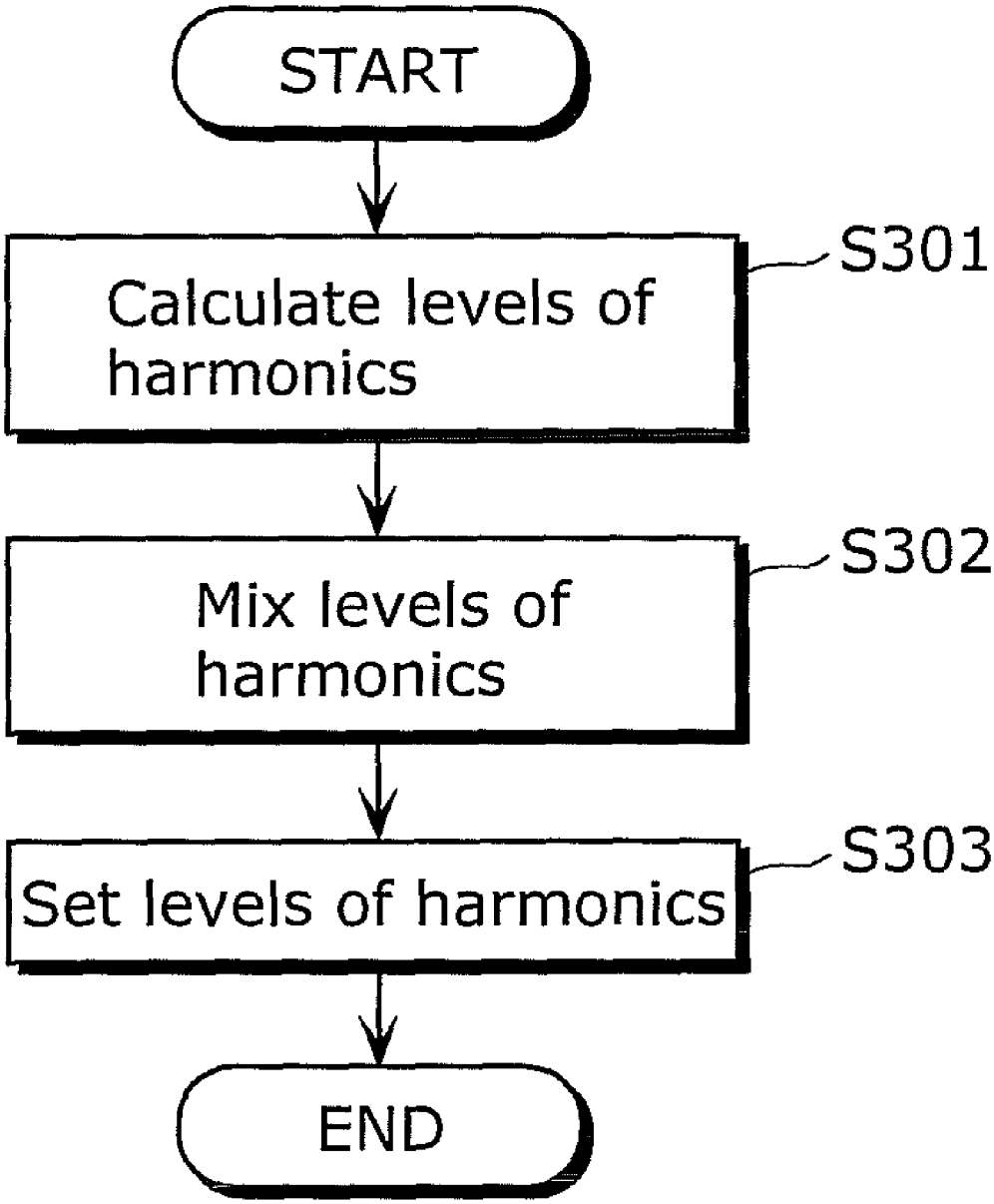
FIG. 11 is a flowchart of the low-frequency mixing process (S201 in FIG. 7) according to Embodiment 1 in the present invention.

Next, the low-frequency mixing process will be described in more detail. FIG. 11 is a flowchart of the low-frequency mixing process.

The low-frequency harmonic level calculating unit 202*a* calculates levels of harmonics of a target sound source waveform. Furthermore, the low-frequency harmonic level calculating unit 202*b* calculates levels of harmonics of an input sound source waveform (Step S301). More specifically, the low-frequency harmonic level calculating unit 202*a* calculates the levels of harmonics using the fundamental frequency of the target sound source waveform calculated at Step S103 and the target sound source spectrum generated at Step S105. Since the harmonic occurs at a frequency of an integer multiple of the fundamental frequency, the low-frequency harmonic level calculating unit 202*a* calculates a value of a target sound source spectrum at a frequency "n" times as high as the fundamental frequency, where "n" is a natural number. Assuming that the target sound source spectrum is denoted as F(f) and the fundamental frequency is denoted as F0, the n-th harmonic level H(n) is calculated using Equation 2. The low-frequency harmonic level calculating unit 202*b* calculates the levels of harmonics in the same manner as the low-frequency harmonic level calculating unit 202*a*. In an input sound source spectrum in FIG. 12, a first harmonic level 11, a second harmonic level 12, and a third harmonic level 13 are calculated using the fundamental frequency ($F0_A$) of the input sound source waveform. Similarly, in a target sound source spectrum, a first harmonic level 21, a second harmonic level 22, and a third harmonic level 23 are calculated using the fundamental frequency ($F0_B$) of the target sound source waveform.

$$H(n)=F(nF0) \quad \text{[Equation 2]}$$

The harmonic level mixing unit 203 mixes the levels of harmonics of the input speech and the levels of harmonics of the target speech that are calculated at Step S301, respectively, for each harmonic (order) (Step S302). Assuming that $H^s$ denotes the levels of harmonics of the input speech and $H^t$ denotes the levels of harmonics of the target speech, the harmonic level H after the mixing can be calculated from Equation 3.

Figure 12:
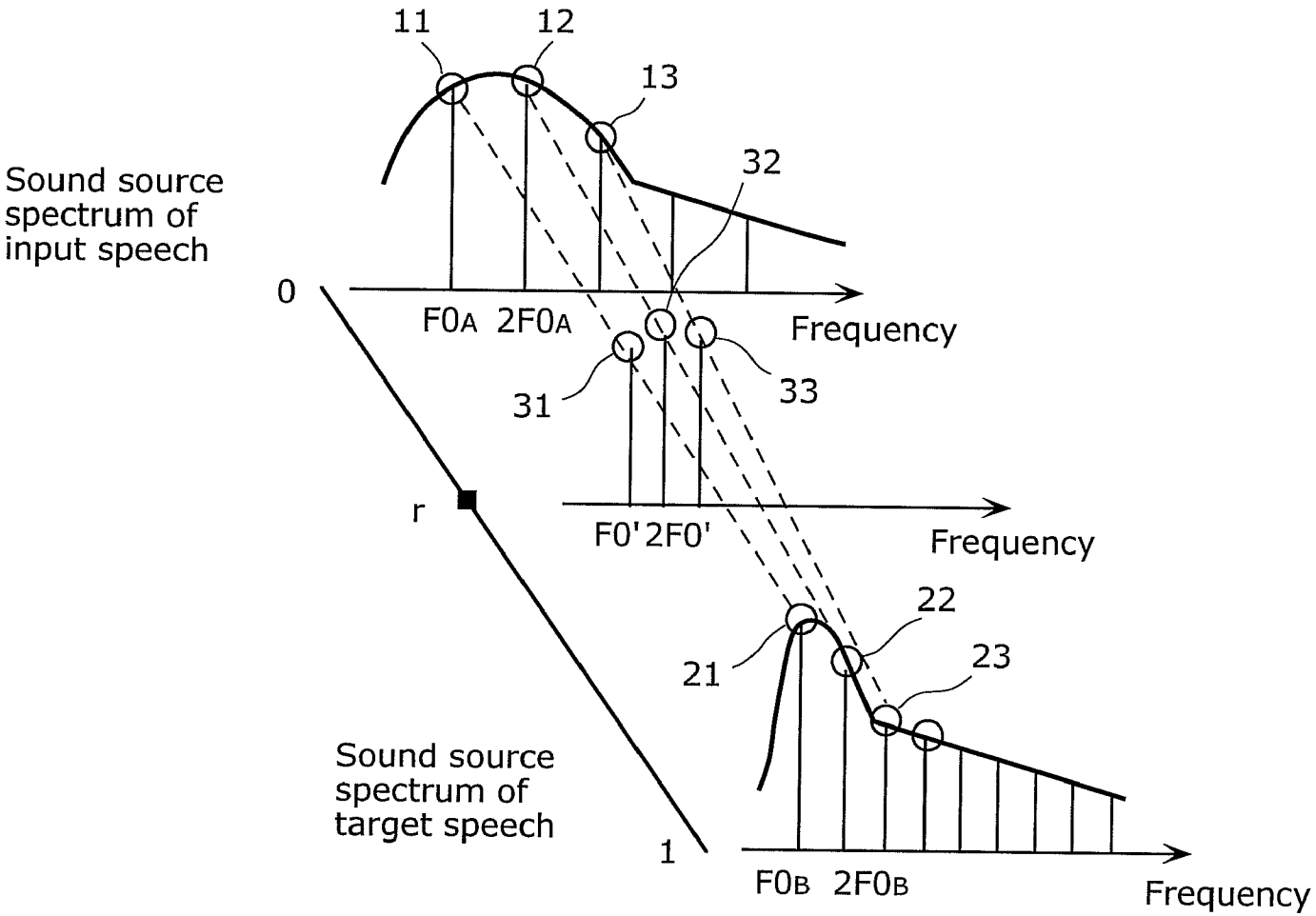
FIG. 12 illustrates operations of a harmonic level mixing unit.

In FIG. 12, a first harmonic level 31, a second harmonic level 32, and a third harmonic level 33 are obtained by mixing, at the conversion ratio r, the first harmonic level 11, the second harmonic level 12, and the third harmonic level 13 of the input sound source spectrum with the first harmonic level 21, the second harmonic level 22, and the third harmonic level 23 of the target sound source spectrum, respectively.

$$H(n)=rH^s(n)+(1-r)H^t(n) \quad \text{[Equation 3]}$$

The harmonic level mixing unit 203 sets the levels of harmonics calculated at Step S302 on the frequency axis using a fundamental frequency after conversion (Step S303). Here, the fundamental frequency F0' after conversion is calculated by Equation 4 using a fundamental frequency F0$^s$ of an input sound source waveform, a fundamental frequency F0$^t$ of a target sound source waveform, and the conversion ratio r.

$$F0'=rF0^s+(1-r)F0^t \quad \text{[Equation 4]}$$

Furthermore, with Equation 5, the harmonic level mixing unit 203 calculates a sound source spectrum F' after transformation using the calculated F0'.

$$F'(nF0')=H(n) \quad \text{[Equation 5]}$$

Thus, the sound source spectrum after the transformation can be generated in the frequency range equal to or lower than the boundary frequency.

Figure 13:
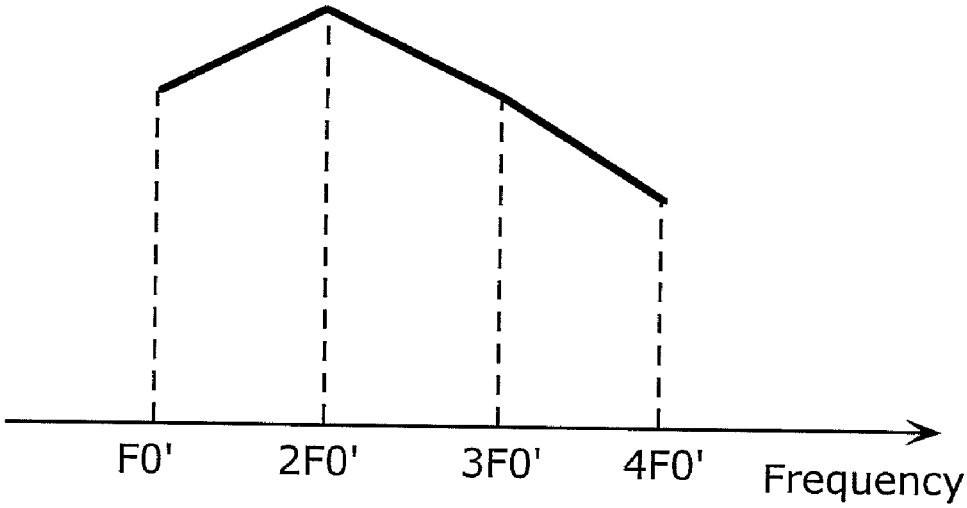
FIG. 13 illustrates an example of interpolation in a sound source spectrum by the harmonic level mixing unit.

The spectral intensity other than positions of the harmonics can be calculated using interpolation. The interpolation method is not particularly limited. For example, the harmonic level mixing unit 203 linearly interpolates the spectral intensity using the k-th harmonic level and the (k+1)-th harmonic level that are adjacent to a target frequency f as indicated by Equation 6. FIG. 13 illustrates an example of the spectral intensity after the linear interpolation.

$$F'(f)=\frac{F'((k+1)F0')-F'(kF0')}{F0'}(f-kF0')+F'(kF0') \quad \text{[Equation 6]}$$

$$k=\left[\frac{f}{F0'}\right]$$

Figure 14:
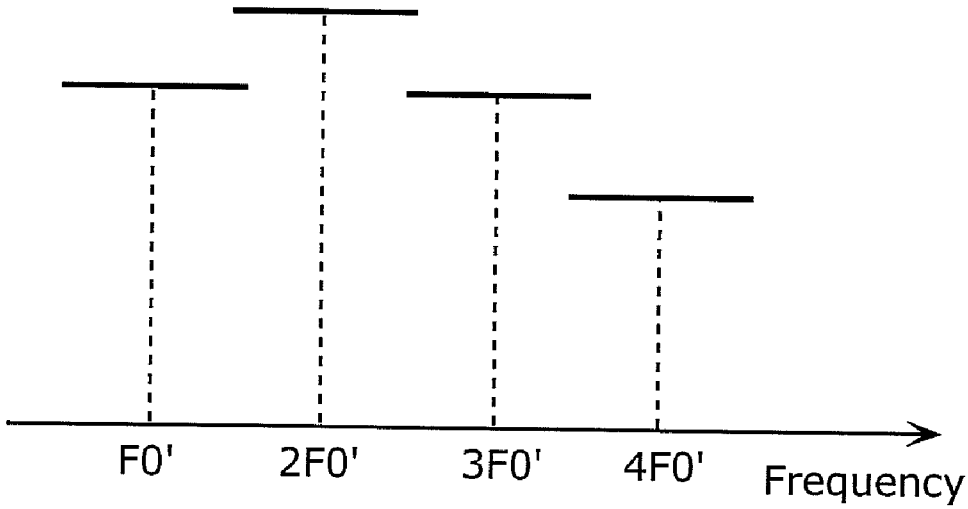
FIG. 14 illustrates an example of interpolation in a sound source spectrum by the harmonic level mixing unit.

Furthermore, as illustrated in FIG. 14, the harmonic level mixing unit 203 may interpolate the spectral intensity using a level of a harmonic that is the closest to the target frequency in accordance with Equation 7. The spectral intensity varies in a stepwise manner.

$$F'(f)=F'(kF0'),(k-0.5)F0'<f\leqq(k+0.5)F0'k=1,2,\ldots \quad \text{[Equation 7]}$$

Figure 15:
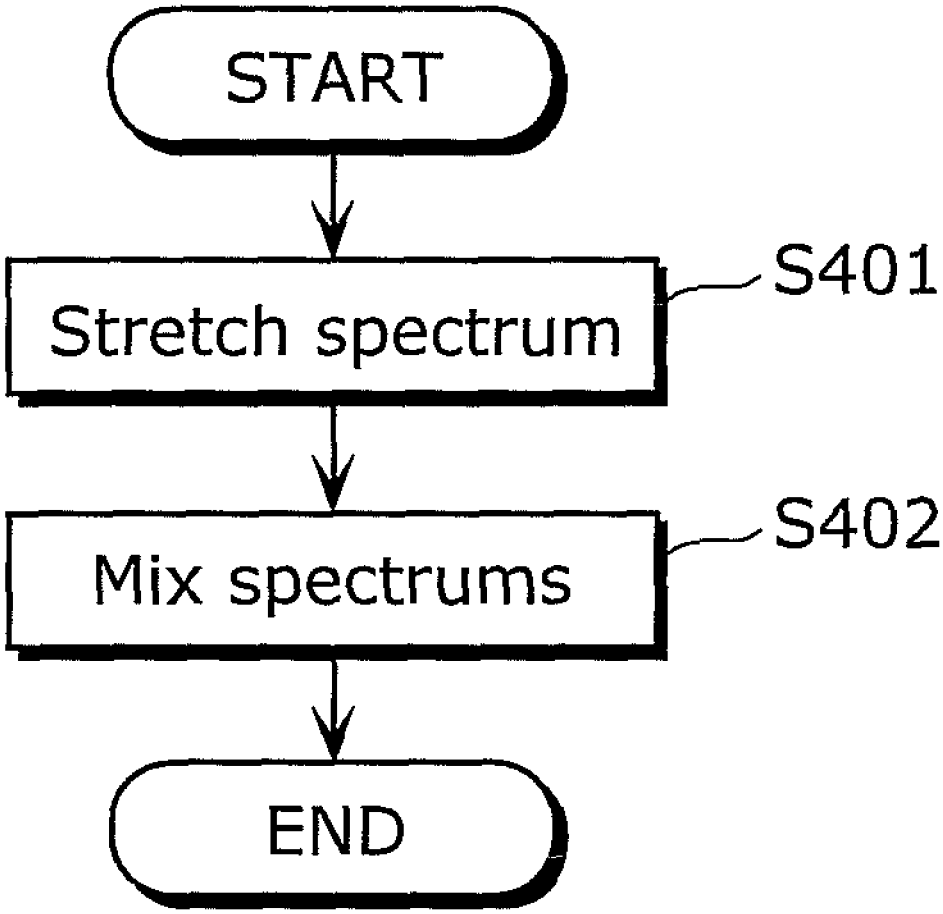
FIG. 15 is a flowchart of the low-frequency mixing process (S201 in FIG. 7) according to Embodiment 1 in the present invention.

With the processes, the low-frequency harmonic levels can be mixed. Here, the harmonic level mixing unit 203 can generate a low-frequency sound source spectrum by stretching the frequency. FIG. 15 is a flowchart of the low-frequency mixing process (S201 in FIG. 7) by stretching the frequency.

The harmonic level mixing unit 203 stretches an input sound source spectrum $F_s$, based on a ratio of a fundamental frequency F0$^s$ of the input sound source waveform to a fundamental frequency F0' obtained from a low-frequency harmonic level calculating unit (F0'/F0$^s$). Furthermore, the harmonic level mixing unit 203 stretches a target sound source spectrum $F_t$, based on a ratio of a fundamental frequency F0$^t$ of the target sound source waveform to the fundamental frequency F0' (F0'/F0$^t$) (Step S401). More specifically, the input sound source spectrum $F_s'$ and the target sound source spectrum $F_t'$ are calculated using Equation 8.

$$F_s'(f)=F_s\left(\frac{F0'}{F0_s}f\right) \quad \text{[Equation 8]}$$

-continued $$F_t'(f)=F_t\left(\frac{F0'}{F0_t}f\right)$$

The harmonic level mixing unit 203 mixes the stretched input sound source spectrum $F_s'$ and target sound source spectrum $F_t'$ at the conversion ratio r to obtain a resulting sound source spectrum F' (Step S402). More specifically, two sound source spectrums are mixed using Equation 9.

$$F'(f)=rF'_s(f)+(1-r)F_t'(f) \quad \text{[Equation 9]}$$

As described above, the voice quality feature resulted from the low-frequency sound source spectrum can be morphed between an input speech and a target speech by mixing the levels of harmonics.

(High-Frequency Mixing Process)

Next, the process of mixing the input sound source spectrum and the target sound source spectrum in a higher frequency range (Step S202 in FIG. 7) will be described in more detail.

Figure 16:
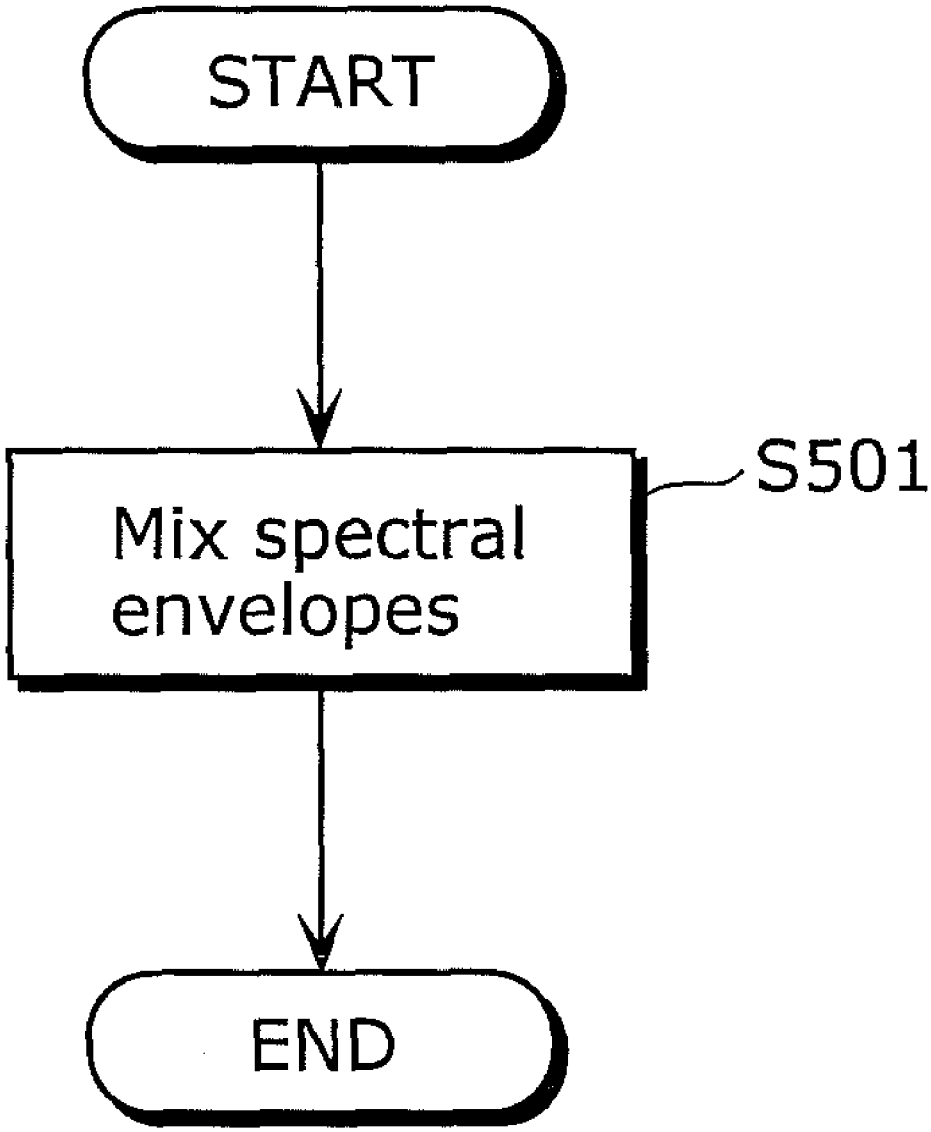
FIG. 16 is a flowchart of a high-frequency mixing process according to Embodiment 1 in the present invention.

FIG. 16 is a flowchart of the high-frequency mixing process.

The high-frequency spectral envelope mixing unit 204 mixes the input sound source spectrum $F_s$ and the target sound source spectrum $F_t$ at the conversion ratio r (Step S501). More specifically, two sound source spectrums are mixed using Equation 10.

$$F'(f)=rF_s(f)+(1-r)F_t(f) \quad \text{[Equation 10]}$$

Figure 17:
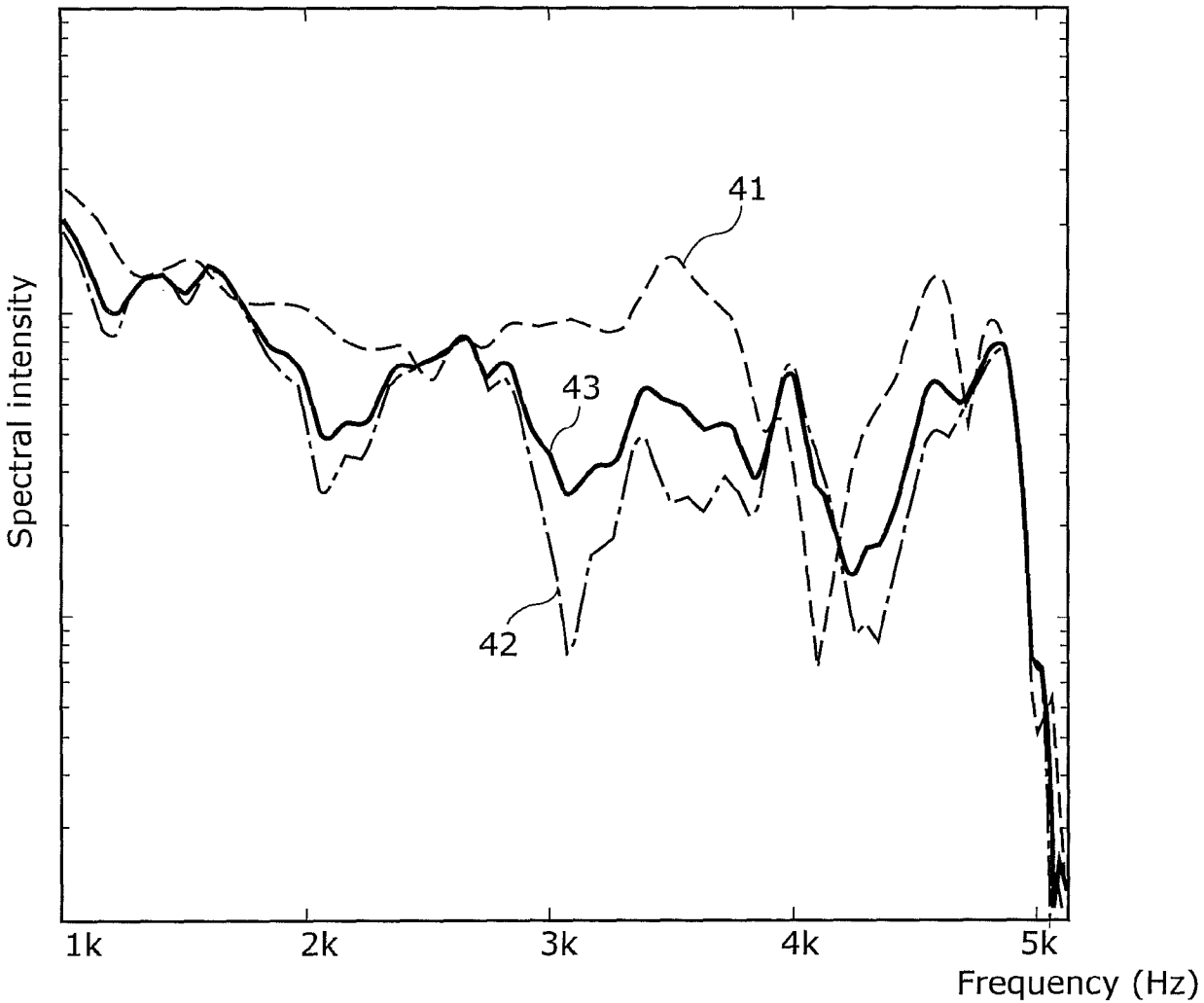
FIG. 17 illustrates operations of a high-frequency spectral envelope mixing unit.

Accordingly, the high-frequency spectral envelopes can be mixed. FIG. 17 illustrates a specific example of mixing the spectral envelopes. The horizontal axis indicates the frequency, and the vertical axis indicates the spectral intensity of the sound source spectrum. Here, the vertical axis is represented by the logarithm. An input sound source spectrum 41 and a target sound source spectrum 42 are mixed at a conversion ration 0.8 to obtain a resulting sound source spectrum 43. As obvious from the resulting sound source spectrum 43 in FIG. 17, the sound source spectrum can be transformed between 1 kHz and 5 kHz while maintaining the fine structure.

(Use of a Spectral Tilt)

Regarding the method of mixing the high-frequency spectral envelopes, an input sound source spectrum and a target sound source spectrum may be mixed by transforming a spectral tilt of the input sound source spectrum into a spectral tilt of the target sound source spectrum at the conversion ratio r. The spectral tilt is one of the personal features, and is a tilt (gradient) with respect to a frequency axis of the sound source spectrum. For example, the spectral tilt can be represented using a difference in spectral intensity between the boundary frequency (Fb) and 3 kHz. As the spectral tilt becomes smaller, the sound source contains much frequency components, whereas as the spectral tilt becomes larger, the sound source contains less frequency components.

Figure 18:
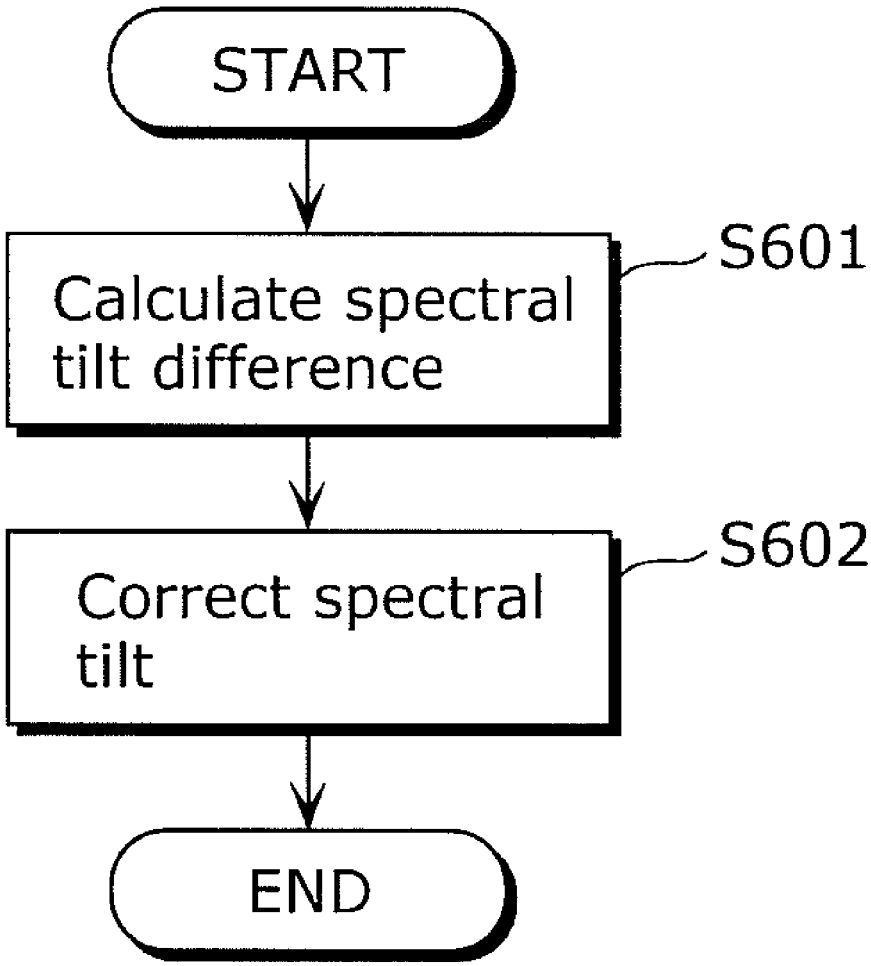
FIG. 18 illustrates a flowchart of processes of mixing high-frequency spectral envelopes according to Embodiment 1 in the present invention.

FIG. 18 illustrates a flowchart of the processes of mixing the high-frequency spectral envelopes by transforming the spectral tilt of the input sound source spectrum into the spectral tilt of the target sound source spectrum.

The high-frequency spectral envelope mixing unit 204 calculates a spectral tilt difference that is a difference between the spectral tilt of the input sound source spectrum and the spectral tilt of the target sound source spectrum (Step S601). The method of calculating the spectral tilt difference is not particularly limited. For example, the spectral tilt difference may be calculated using a difference in spectral intensity between the boundary frequency (Fb) and 3 kHz.

The high-frequency spectral envelope mixing unit 204 corrects a spectral tilt of the input sound source spectrum using the spectral tilt difference calculated at Step S601 (Step S602). The method of correcting the spectral tilt is not particularly limited. For example, an input sound source spectrum U(z) is corrected by passing through an infinite impulse response (IIR) filter D(z) as in Equation 11. Thereby, an input sound source spectrum U'(z) in which the spectral tilt has been corrected can be obtained.

$$U'(z) = U(z)D(z) \quad \text{[Equation 11]}$$

$$D(z) = \left(\frac{1-d_s}{1-d_s z^{-1}}\right)^2$$

$$d_s = \frac{T - \cos\omega_s - \sqrt{(T-\cos\omega_s)^2 - (T-1)^2}}{T-1}$$

$$\omega_s = 2\pi 3000/Fs$$

Here, U'(z) denotes a sound source waveform after correction, U(z) denotes a sound source waveform, D(z) denotes a filter for correcting the spectral tilt, T denotes a level difference (spectral tilt difference) between a tilt of the input sound source spectrum and a tilt of the target sound source spectrum, and Fs denotes the sampling frequency.

Here, a spectrum may be transformed directly on a Fast Fourier Transform (FFT) spectrum as the method of interpolation for the spectral tilt. For example, a regression line for a spectrum over the boundary frequency is calculated using an input sound source spectrum $F_s(n)$. $F_s(n)$ can be represented using coefficients of the calculated regression line ($a_s$, $b_s$) in Equation 12.

$$F_s(n)=a_s n+b_s+e_s(n) \quad \text{[Equation 12]}$$

Here, $e_s(n)$ denotes an error between the input sound source spectrum and the regression line.

Similarly, the target sound source spectrum $F_t(n)$ can be represented by Equation 13.

$$F_t(n)=a_t n+b_t+e_t(n) \quad \text{[Equation 13]}$$

As indicated in Equation 14, each coefficient of the regression line between the input sound source spectrum and the target sound source spectrum is interpolated at the conversion ratio r.

$$a=r\cdot a_s+(1-r)a_t$$

$$b=r\cdot b_s+(1-r)b_t \quad \text{[Equation 14]}$$

The spectral tilt of a sound source spectrum may be transformed to calculate a resulting spectrum F'(n), by transforming the input sound source spectrum using the calculated regression line in Equation 15.

$$F'(n)=an+b+e_s(n) \quad \text{[Equation 15]}$$

(Advantage)

With the configuration, the input sound source spectrum can be transformed by separately controlling each level of harmonics that characterize the voice quality in a frequency range equal to or lower than the boundary frequency. Furthermore, the input sound source spectrum can be transformed by changing a shape of a spectral envelope that characterizes the voice quality in a frequency range higher than the boundary frequency. Thus, a synthesized speech can be generated by converting the voice quality into natural voice quality.

Embodiment 2

Generally, a synthesized speech is generated in a text-to-speech synthesis system in the following method. In other words, target prosody information such as a fundamental frequency pattern in accordance with input text is generated by analyzing input text. Furthermore, speech elements in accordance with the generated target prosody information are selected, the selected speech elements are transformed into target information items, and the target information items are connected to each other. Thereby, the synthesized speech having the target prosody information is generated.

In order to change the pitch of a speech, each of the so fundamental frequencies of the selected speech elements needs to be transformed into a corresponding one of the target fundamental frequencies. Here, degradation in the sound quality can be suppressed by transforming only a fundamental frequency without changing sound source features other than the fundamental frequency. Embodiment 2 according to the present invention will describe an apparatus that prevents the degradation in the sound quality and change in the voice quality by transforming only a fundamental frequency without changing sound source features other than the fundamental frequency.

The pitch synchronous overlap add (PSOLA) method is known as a method of editing a speech waveform by transforming the fundamental frequency ("Diphone Synthesis using an Overlap-Add technique for Speech Waveforms Concatenation", Proceedings of IEEE International Conference on Acoustic Speech Signal Processing, 1986, pp. 2015-2018).

Figure 19:
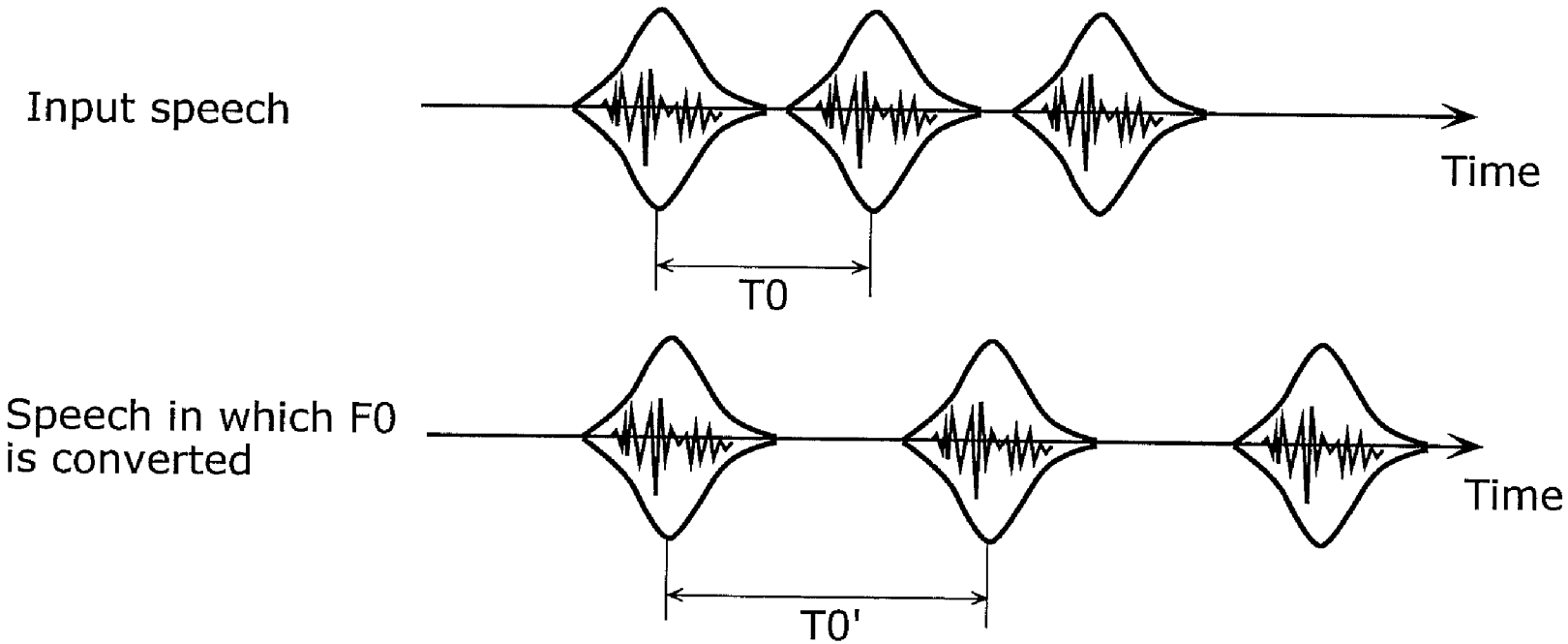
FIG. 19 is a conceptual scheme of converting a fundamental frequency in the PSOLA method.

As illustrated in FIG. 19 in the PSOLA method, an input waveform is extracted for each cycle, and the fundamental frequency of the speech is transformed into another by rearranging the extracted input waveforms at predetermined fundamental period intervals (TO'). What is known in the PSOLA method is that favorable transformation result can be obtained when the modified amounts in the fundamental frequency are small.

Figure 20:
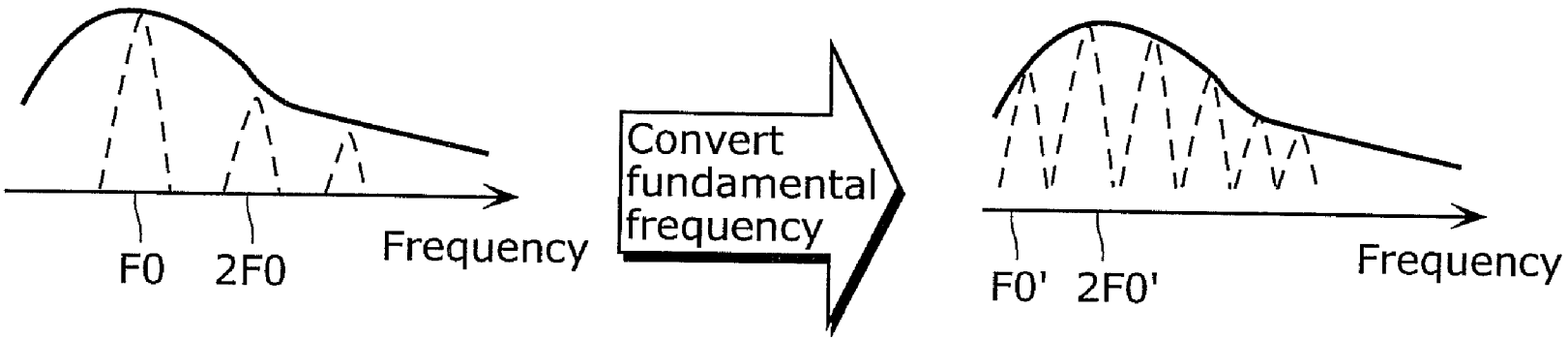
FIG. 20 illustrates changes in levels of harmonics when the fundamental frequency has been converted in the PSOLA method.

Suppose that the PSOLA method is applied to the transformation of sound source information to change the fundamental frequency. The graph on the left of FIG. 20 illustrates a sound source spectrum prior to the change in the fundamental frequency. Here, the solid line represents a spectral envelope of a sound source spectrum, and each dashed line represents a spectrum of a single extracted pitch waveform. The spectrums of the single pitch waveforms form a spectral envelope of the sound source spectrum. When the fundamental frequency is changed using the PSOLA method, a spectral envelope of a sound source spectrum represented by the solid line in the graph on the right of FIG. 20 can be obtained. Since the fundamental frequency is changed, the sound source spectrum in the graph on the right of FIG. 20 contains the harmonics at positions different from frequencies of the original spectrum. Here, since the spectral envelope does not vary before and after changing the fundamental frequency, the first harmonic level (fundamental) and the second harmonic level are different from those before changing the fundamental frequency. Thus, there are cases where the magnitude relation between the first harmonic level and the second harmonic level may reverse. For example, in the sound source spectrum before changing the fundamental frequency in the graph on the left of FIG. 20, the first harmonic level (level at the frequency F0) is larger than the second harmonic level (level at the frequency 2F0). However, in the sound source spectrum after changing the fundamental frequency in the graph on the right of FIG. 20, the second harmonic level (level at the frequency 2F0) is larger than the first harmonic level (level at the frequency F0).

As described above, since the fine structure of the spectrum of the sound source waveform can be represented in the PSOLA method, there is an advantage that the sound quality of a synthesized speech is superior. On the other hand, when the fundamental frequency is largely changed, the difference between the first harmonic level and the second harmonic level changes. Thus, there is a problem that the voice quality is changed in a lower frequency range where each of the harmonics is separately perceived.

The pitch conversion apparatus according to Embodiment 2 can change only the pitch without changing the voice quality.

(Overall Configuration)

Figure 21:
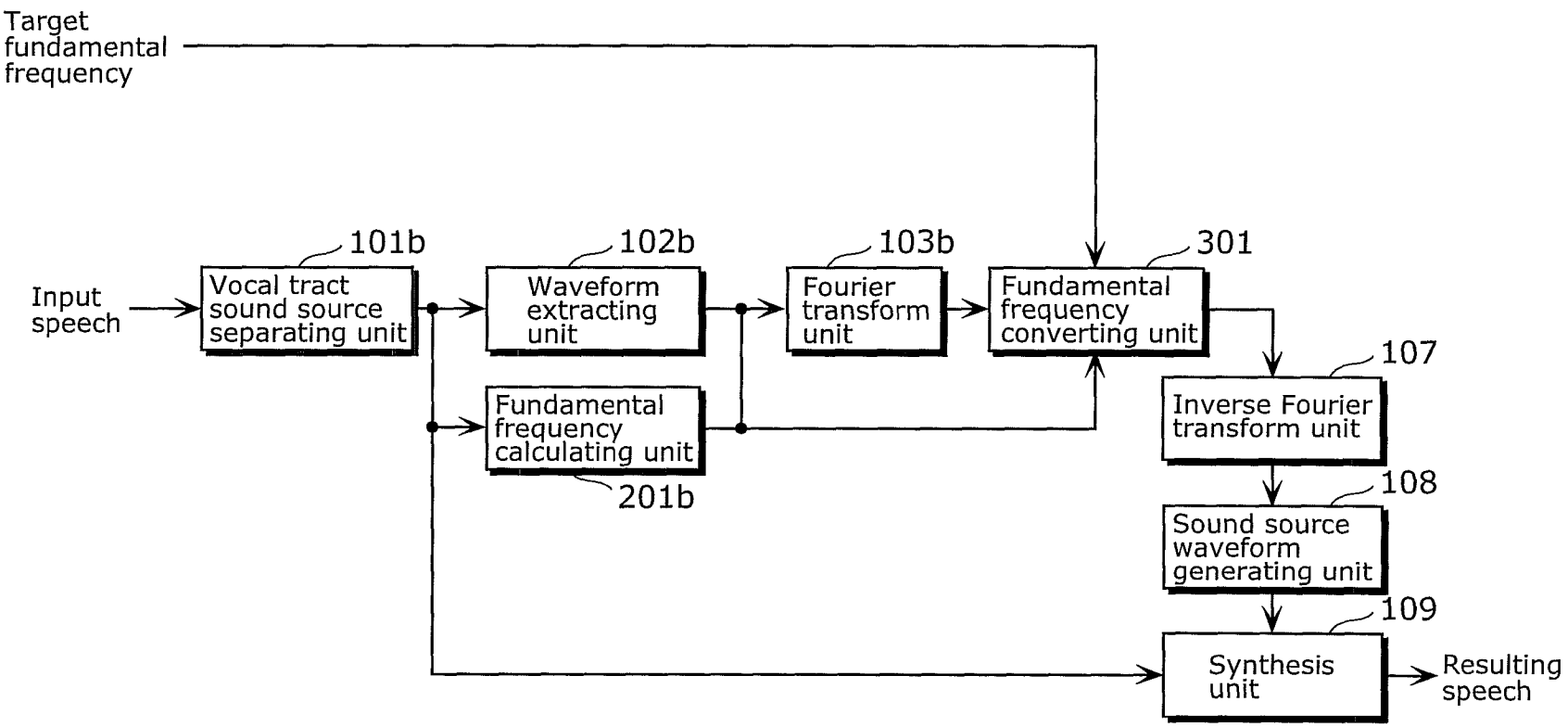
FIG. 21 is a functional block diagram illustrating a configuration of a pitch conversion apparatus according to Embodiment 2 in the present invention.

FIG. 21 is a functional block diagram illustrating a configuration of a pitch conversion apparatus according to Embodiment 2 in the present invention. In FIG. 21, the constituent elements same as those of FIG. 2 are numbered by the same numerals, and the detailed description thereof will be omitted.

The pitch conversion apparatus includes a vocal tract sound source separating unit 101*b*, a waveform extracting unit 102*b*, a fundamental frequency calculating unit 201*b*, a Fourier transform unit 103*b*, a fundamental frequency converting unit 301, an inverse Fourier transform unit 107, a sound source waveform generating unit 108, and a synthesis unit 109.

The vocal tract sound source separating unit 101*b* separates an input speech waveform that is a speech waveform of an input speech into vocal tract information and sound source information by analyzing the input speech waveform. The separation method is the same as that of Embodiment 1.

The waveform extracting unit 102*b* extracts a waveform from a sound source waveform representing the sound source information separated by the vocal tract sound source separating unit 101*b*.

The fundamental frequency calculating unit 201*b* calculates a fundamental frequency of the sound source waveform extracted by the waveform extracting unit 102*b*.

The Fourier transform unit 103*b* Fourier-transforms the sound source waveform extracted by the waveform extracting unit 102*b* into an input sound source spectrum. The Fourier transform unit 103*a* corresponds to a sound source spectrum calculating unit according to an aspect of the present invention.

The fundamental frequency converting unit 301 converts the fundamental frequency of the input sound source waveform indicated by the sound source information separated by the vocal tract sound source separating unit 101*b* into the target fundamental frequency provided from outside of the pitch conversion apparatus to generate an input sound source spectrum. The method of converting the fundamental frequency will be described later.

The inverse Fourier transform unit 107 inverse-Fourier-transforms the input sound source spectrum generated by the fundamental frequency converting unit 301 into one cycle of a time waveform.

The sound source waveform generating unit 108 generates a sound source waveform by setting one cycle of the time waveform generated by the inverse Fourier transform unit 107 to a position with respect to the fundamental frequency. The sound source waveform generating unit 108 repeats the process for each fundamental period to generate sound source waveforms.

The synthesis unit 109 synthesizes the vocal tract information separated by the vocal tract sound source separating unit 101*b* and another sound source waveform generated by the sound source waveform generating unit 108 to generate a synthesized speech waveform. The inverse Fourier transform unit 107, the sound source waveform generating unit 108, and the synthesis unit 109 correspond to a synthesis unit according to an aspect of the present invention.

Embodiment 2 in the present invention differs from Embodiment 1 in that only the fundamental frequency is converted into another without changing the features other than the fundamental frequency of the sound source of an input speech, such as the spectral tilt and OQ.

(Detailed Configuration)

Figure 22:
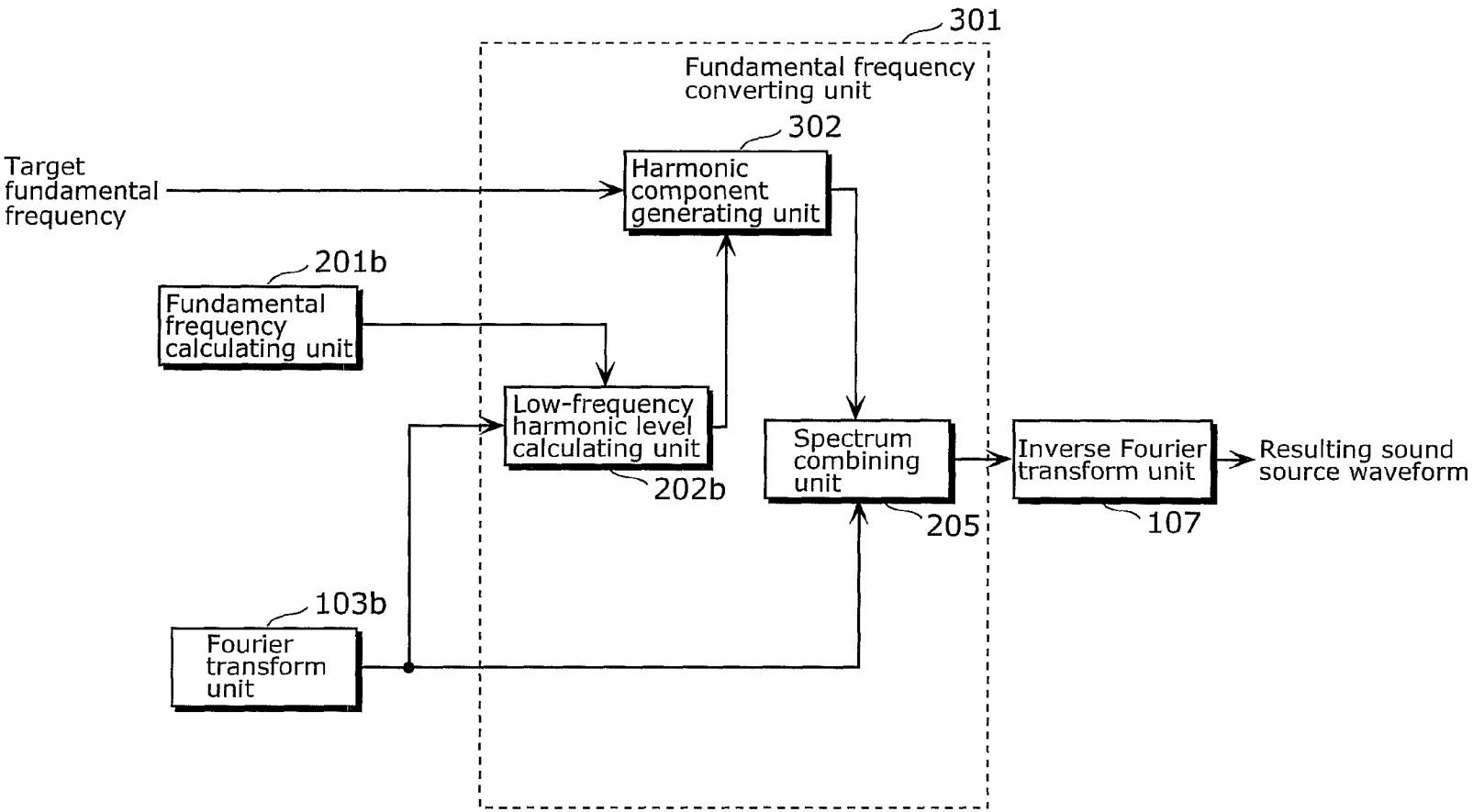
FIG. 22 is a functional block diagram illustrating a configuration of a fundamental frequency converting unit according to Embodiment 2 in the present invention.

FIG. 22 is a block diagram illustrating a detailed functional configuration of the fundamental frequency converting unit 301.

The fundamental frequency converting unit 301 includes a low-frequency harmonic level calculating unit 202*b*, a harmonic component generating unit 302, and a spectrum combining unit 205.

The low-frequency harmonic level calculating unit 202*b* calculates levels of harmonics of an input sound source waveform using the fundamental frequency calculated by the fundamental frequency calculating unit 201*b* and the input sound source spectrum calculated by the Fourier transform unit 103*b*.

The harmonic component generating unit 302 sets the levels of harmonics of the input sound source waveform calculated by the low-frequency harmonic level calculating unit 202*b* in a frequency range equal to or lower than the boundary frequency (Fb) described in Embodiment 1, to positions of the harmonics calculated by the target fundamental frequency provided from outside of the pitch conversion apparatus to calculate a resulting a sound source spectrum. The low-frequency harmonic level calculating unit 202*b* and the harmonic component generating unit 302 correspond to a low-frequency spectrum calculating unit according to an aspect of the present invention.

The spectrum combining unit 205 combines, at the boundary frequency (Fb), the sound source spectrum generated by the harmonic component generating unit 302 in the frequency range equal to or lower than the boundary frequency (Fb), with an input sound source spectrum in a frequency range larger than the boundary frequency (Fb) among the input sound source spectrums obtained by the Fourier transform unit 103*b* to generate a sound source spectrum for the entire frequency range.

(Description of Operations)

Next, the specific operations performed by the pitch conversion apparatus according to Embodiment 2 in the present invention will be described using a flowchart.

The processes performed by the pitch conversion apparatus are divided into processes of obtaining an input sound source spectrum from an input speech waveform and processes of transforming the input speech waveform with transformation of the input sound source spectrum.

The former processes are the same as those described with reference to FIG. 4 in Embodiment 1 (Steps S101 to S105). Thus, the detailed description will not be repeated hereinafter. The following will describe the latter processes.

Figure 23:
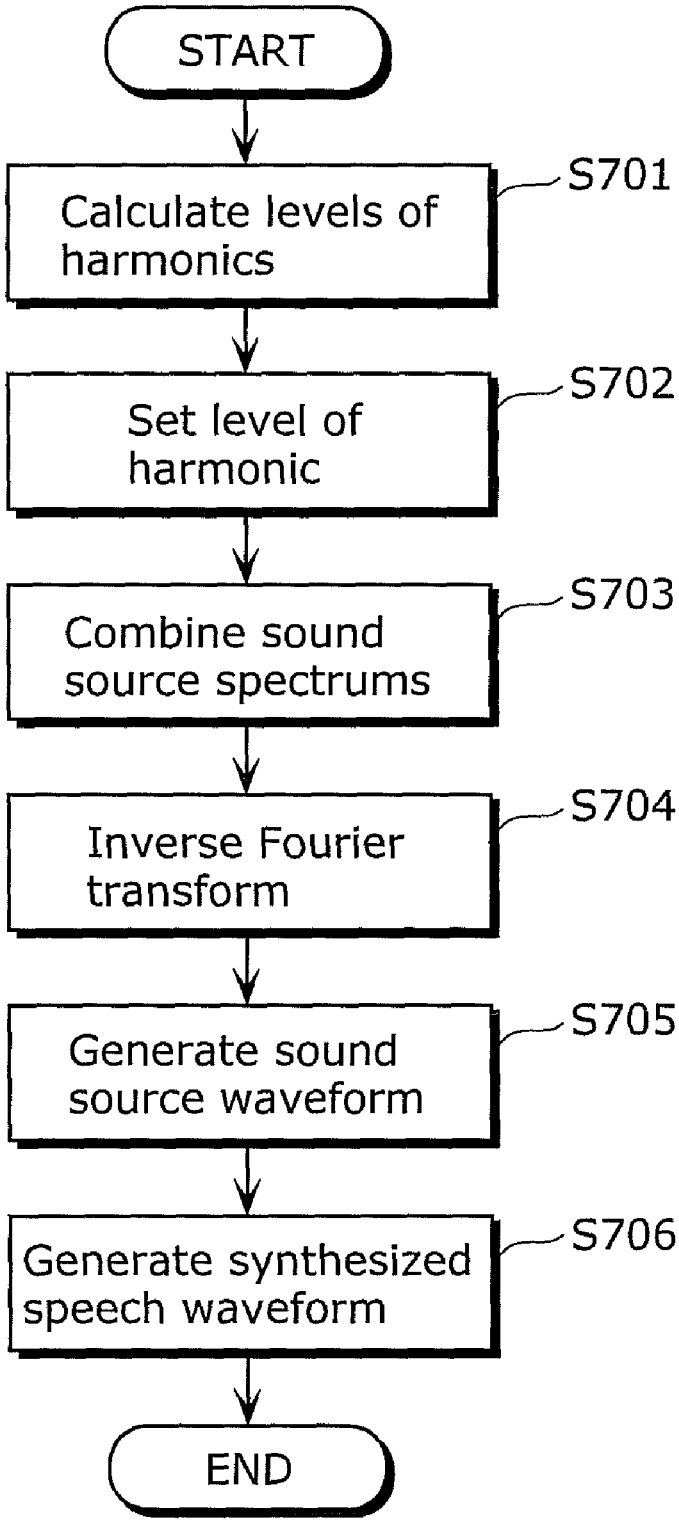
FIG. 23 is a flowchart of processes performed by the pitch conversion apparatus according to Embodiment 2 in the present invention.

FIG. 23 is a flowchart of processes performed by the pitch conversion apparatus according to Embodiment 2 in the present invention.

The low-frequency harmonic level calculating unit 202*b* calculates levels of harmonics of an input sound source waveform (Step S701). More specifically, the low-frequency harmonic level calculating unit 202*b* calculates the levels of harmonics using the fundamental frequency of the input sound source waveform calculated at Step S103 and the input sound source spectrum calculated at Step S105. Since the harmonic occurs at a frequency of an integer multiple of the fundamental frequency, the low-frequency harmonic level calculating unit 202*b* calculates the intensity of the input sound source spectrum at a frequency "n" times as high as the fundamental frequency of the input sound source waveform, where "n" is a natural number. Assuming that the input sound source spectrum is denoted as F(f) and the fundamental frequency of the input sound source waveform is denoted as F0, the n-th harmonic level H(n) is calculated using Equation 2.

The harmonic component generating unit 302 sets the harmonic level H(n) calculated at Step S701 to a position of a harmonic calculated using the input target fundamental frequency F0' (Step S702). More specifically, the level of harmonic is calculated using Equation 5. Furthermore, the spectral intensity other than positions of harmonics can be calculated using interpolation as described in Embodiment 1. Thereby, the sound source spectrum in which the fundamental frequency of the input sound source waveform is converted into the target fundamental frequency is generated.

The spectrum combining unit 205 combines the sound source spectrum generated at Step S702 with the input sound source spectrum calculated at Step S105 at the boundary frequency (Fb) (Step S703). More specifically, the spectrum calculated at Step S702 is used in the frequency range equal to or lower than the boundary frequency (Fb). Furthermore, one of the input sound source spectrums calculated at Step S105 is used in the frequency range larger than the boundary frequency (Fb). The boundary frequency (Fb) may be determined in the same method as that of Embodiment 1. Furthermore, the spectrums may be combined in the same method as that of Embodiment 1.

The inverse Fourier transform unit 107 inverse-Fourier-transforms the sound source spectrum obtained after the combining at Step S703 into a time domain, and generates one cycle of a time waveform (Step S704).

The sound source waveform generating unit 108 sets one cycle of the time waveform generated at Step S704 to the position of the fundamental period calculated using the target fundamental frequency. With the setting process, one cycle of the sound source waveform is generated. With the repetition of the setting process for each fundamental period, the sound source waveform in which the fundamental frequency of the input speech waveform has been converted to another can be generated (Step S705).

The synthesis unit 109 synthesizes the speech waveform generated by the sound source waveform generating unit 108 and the vocal tract information separated by the vocal tract sound source separating unit 101*b* to generate a synthesized speech waveform (Step S706). The speech synthesis method is the same as that of Embodiment 1.

(Advantage)

With the configuration, the frequency range of a sound source waveform is divided, and harmonics of the low-frequency level are set to positions of the harmonics at the target fundamental frequency. Thereby, the fundamental frequency can be converted to another without changing features of a sound source by maintaining the open quotient and the spectral tilt that are the features of the sound source and are held by the sound source waveform while maintaining the naturalness of the sound source waveform.

Figure 24:
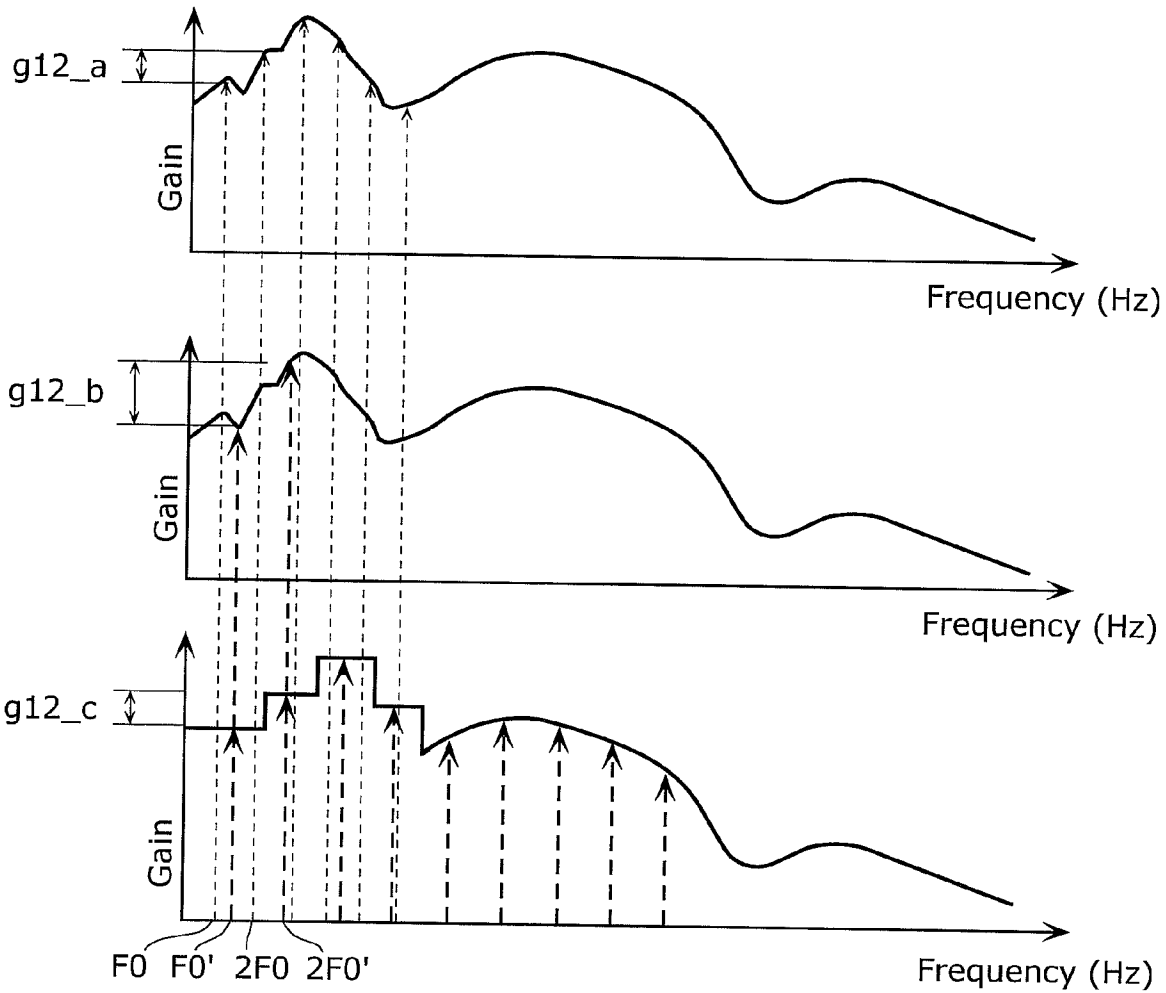
FIG. 24 illustrates a comparison between the PSOLA method and the pitch conversion method according to Embodiment 2 in the present invention.

FIG. 24 illustrates a comparison between the PSOLA method and the pitch conversion method. (a) in FIG. 24 is a graph indicating a spectral envelope of an input sound source spectrum. (b) in FIG. 24 is a graph indicating a sound source spectrum after converting the fundamental frequency in the PSOLA method. (c) in FIG. 24 is a graph indicating a sound source spectrum after converting the fundamental frequency in the pitch conversion method according to Embodiment 2. The horizontal axis indicates the frequency, and the vertical axis indicates the spectral intensity of the sound source spectrum. Furthermore, each up-pointing arrow indicates a position of a harmonic. The fundamental frequency before conversion is indicated by F0, and the fundamental frequency after conversion is indicated by F0'. The sound source spectrum after transformation in the PSOLA method as illustrated in (b) of FIG. 24 has the shape of the spectral envelope identical to that of the sound source spectrum before transformation as illustrated in (a) of FIG. 24. However, the level difference between the first harmonic and the second harmonic before transformation (g12_a) is significantly different from that of after transformation (g12_b) according to the PSOLA method. In contrast, in comparison with the sound source spectrum after transformation in (c) of FIG. 24 according to Embodiment 2 to the sound source spectrum before transformation in (a) of FIG. 24, the level difference between the first harmonic and the second harmonic in a low frequency range before transformation (g12_a) is the same as that of after transformation (g12_b). Thus, the voice quality can be converted while maintaining the open quotient before transformation. Furthermore, shapes of spectral envelopes of the sound source spectrums before and after the transformation are identical in a wide frequency range. Thus, the voice quality can be converted while maintaining the spectral tilt.

Embodiment 3

There are cases where voice recorded when the speaker was nervous is strained and more relaxed voice is desired when using the recorded voice, for example. Normally, voice needs to be re-recorded.

Embodiment 3 will describe the change in impression of softness of voice by converting only the open quotient without the re-recording and without changing the fundamental frequency of the recorded voice.

(Overall Configuration)

Figure 25:
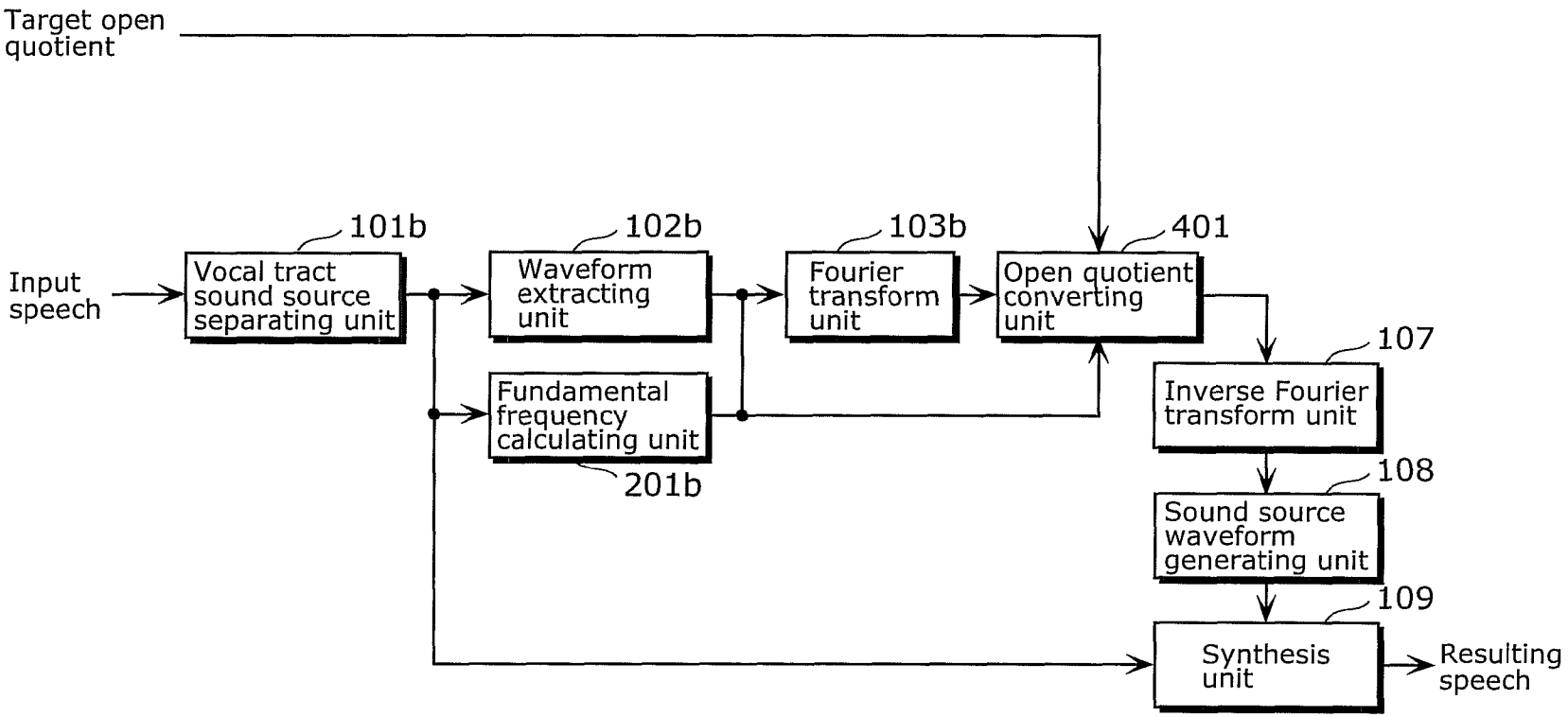
FIG. 25 is a functional block diagram illustrating a configuration of a voice quality conversion apparatus according to Embodiment 3 in the present invention.

FIG. 25 is a functional block diagram illustrating a configuration of a voice quality conversion apparatus according to Embodiment 3 in the present invention. In FIG. 25, the constituent elements same as those of FIG. 2 are numbered by the same numerals, and the detailed description thereof will be omitted.

The voice quality conversion apparatus includes a vocal tract sound source separating unit 101*b*, a waveform extracting unit 102*b*, a fundamental frequency calculating unit 201*b*, a Fourier transform unit 103*b*, an open quotient converting unit 401, an inverse Fourier transform unit 107, a sound source waveform generating unit 108, and a synthesis unit 109.

The vocal tract sound source separating unit 101*b* separates an input speech waveform that is a speech waveform of an input speech into vocal tract information and sound source information by analyzing the input speech waveform. The separation method is the same as that of Embodiment 1.

The waveform extracting unit 102*b* extracts a waveform from a sound source waveform representing the sound source information separated by the vocal tract sound source separating unit 101*b*.

The fundamental frequency calculating unit 201*b* calculates a fundamental frequency of the sound source waveform extracted by the waveform extracting unit 102*b*.

The Fourier transform unit 103*b* Fourier-transforms the sound source waveform extracted by the waveform extracting unit 102*b* into an input sound source spectrum. The Fourier transform unit 103*b* corresponds to a sound source spectrum calculating unit according to an aspect of the present invention.

The open quotient converting unit 401 converts an open quotient of the input sound source waveform indicated by the sound source information separated by the vocal tract sound source separating unit 101*b* into a target open quotient provided from outside of the voice quality conversion apparatus to generate an input sound source spectrum. The method of converting the open quotient will be described later.

The inverse Fourier transform unit 107 inverse-Fourier-transforms the input sound source spectrum generated by the open quotient converting unit 401 to generate one cycle of a time waveform.

The sound source waveform generating unit 108 generates a sound source waveform by setting one cycle of the time waveform generated by the inverse Fourier transform unit 107 to a position with respect to the fundamental frequency. The sound source waveform generating unit 108 repeats the process for each fundamental period to generate sound source waveforms.

The synthesis unit 109 synthesizes the vocal tract information separated by the vocal tract sound source separating unit 101*b* and another sound source waveform generated by the sound source waveform generating unit 108 to generate a synthesized speech waveform. The inverse Fourier transform unit 107, the sound source waveform generating unit 108, and the synthesis unit 109 correspond to a synthesis unit according to an aspect of the present invention.

Embodiment 3 in the present invention differs from Embodiment 1 in that only the open quotient (OQ) is converted without changing the fundamental frequency of the input sound source waveform.

(Detailed Configuration)

Figure 26:
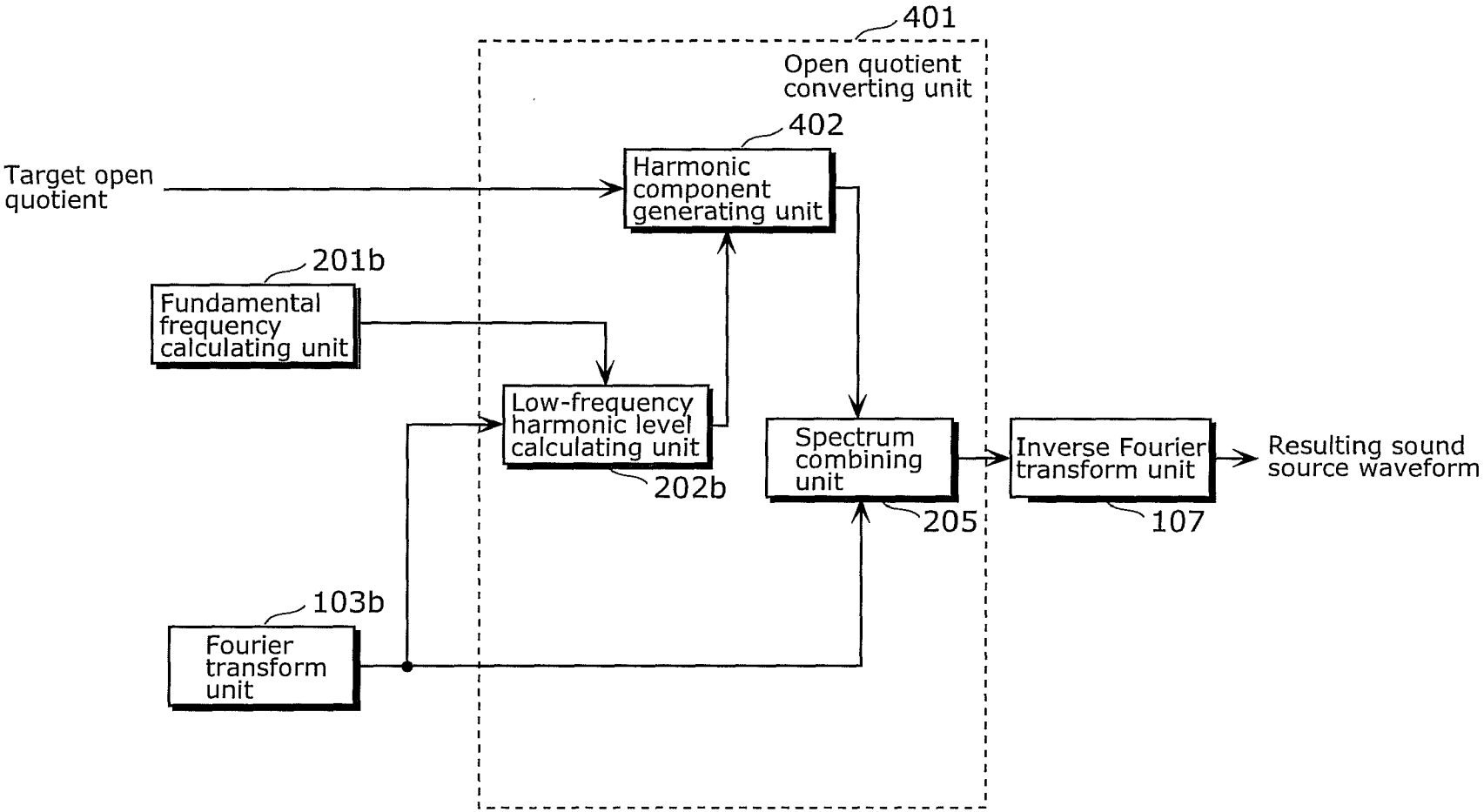
FIG. 26 is a functional block diagram illustrating a configuration of an open quotient converting unit according to Embodiment 3 in the present invention.

FIG. 26 is a block diagram illustrating a detailed functional configuration of the open quotient converting unit 401.

The open quotient converting unit 401 includes a low-frequency harmonic level calculating unit 202*b*, a harmonic component generating unit 402, and a spectrum combining unit 205.

The low-frequency harmonic level calculating unit 202*b* calculates levels of harmonics of an input sound source waveform using the fundamental frequency calculated by the fundamental frequency calculating unit 201*b* and the input sound source spectrum calculated by the Fourier transform unit 103*b*.

The harmonic component generating unit 402 generates a sound source spectrum by transforming one of the first harmonic level and the second harmonic level from among the levels of harmonics of the input sound source waveform calculated by the low-frequency harmonic level calculating unit 202*b* in a frequency range equal to or lower than the boundary frequency (Fb) described in Embodiment 1, at a ratio between the first harmonic level and the second harmonic level. The ratio is determined in accordance with the target open quotient provided from outside of the of the voice quality conversion apparatus.

The spectrum combining unit 205 combines, at the boundary frequency (Fb), the sound source spectrum generated by the harmonic component generating unit 402 in the frequency range equal to or lower than the boundary frequency (Fb), with an input sound source spectrum in a frequency range larger than the boundary frequency (Fb) among the input sound source spectrums obtained by the Fourier transform unit 103*b* to generate a sound source spectrum for the entire frequency range.

(Description of Operations)

Next, the specific operations performed by the voice quality conversion apparatus according to Embodiment 3 in the present invention will be described using a flowchart.

The processes performed by the voice quality conversion apparatus are divided into processes of obtaining an input sound source spectrum from an input speech waveform and processes of transforming the input sound source waveform with transformation of the input sound source spectrum.

The former processes are the same as those described with reference to FIG. 4 in Embodiment 1 (Steps S101 to S105). Thus, the detailed description will not be repeated hereinafter. The following will describe the latter processes.

Figure 27:
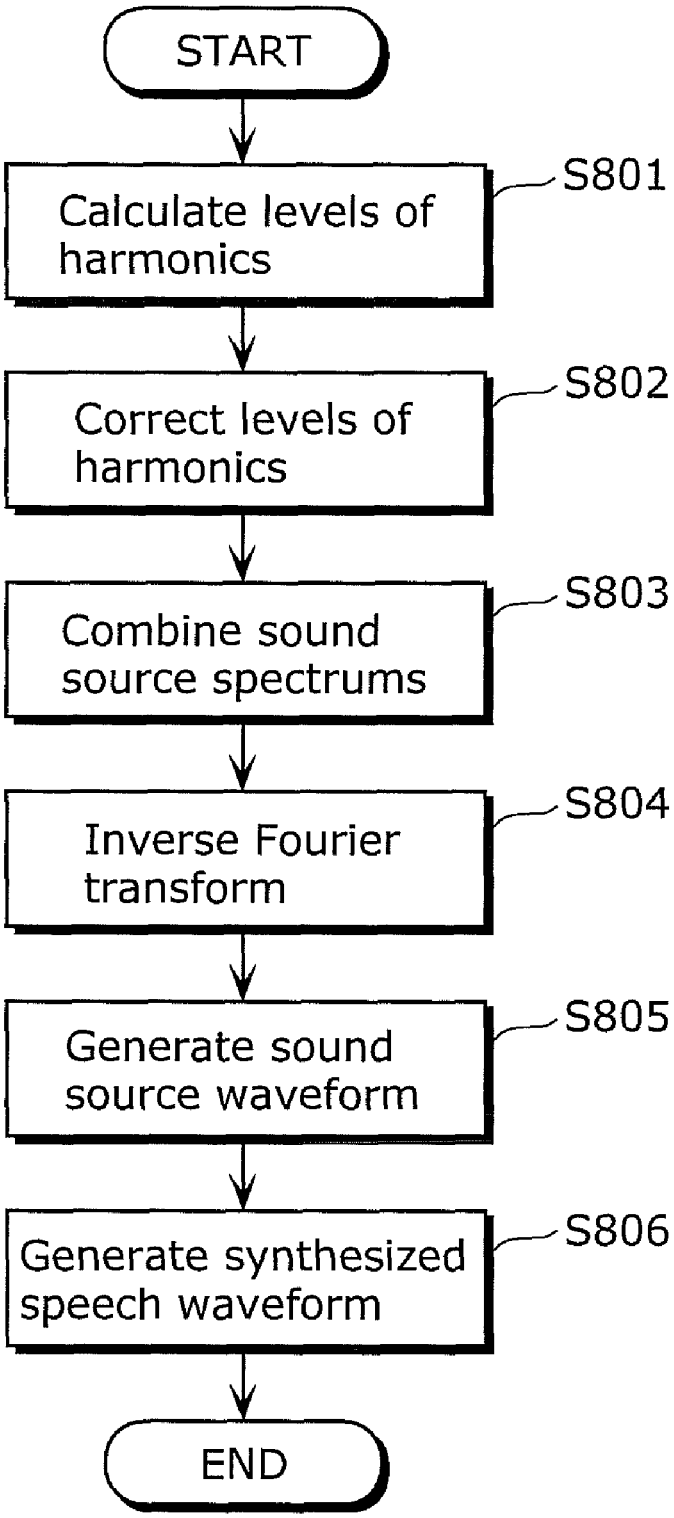
FIG. 27 is a flowchart of processes performed by a voice quality conversion apparatus according to Embodiment 3 in the present invention.

FIG. 27 is a flowchart of processes performed by the voice quality conversion apparatus according to Embodiment 3 in the present invention.

The low-frequency harmonic level calculating unit 202*b* calculates levels of harmonics of an input sound source waveform (Step S801). More specifically, the low-frequency harmonic level calculating unit 202*b* calculates the levels of harmonics using the fundamental frequency of the input sound source waveform calculated at Step S103 and the input sound source spectrum calculated at Step S105. Since the harmonic occurs at a frequency of an integer multiple of the fundamental frequency, the low-frequency harmonic level calculating unit 202*b* calculates the intensity of the input sound source spectrum at a frequency "n" times as high as the fundamental frequency of the input sound source waveform, where "n" is a natural number. Assuming that the input sound source spectrum is denoted as F(f) and the fundamental frequency of the input sound source waveform is denoted as F0, the n-th harmonic level H(n) is calculated using Equation 2.

Figure 28:
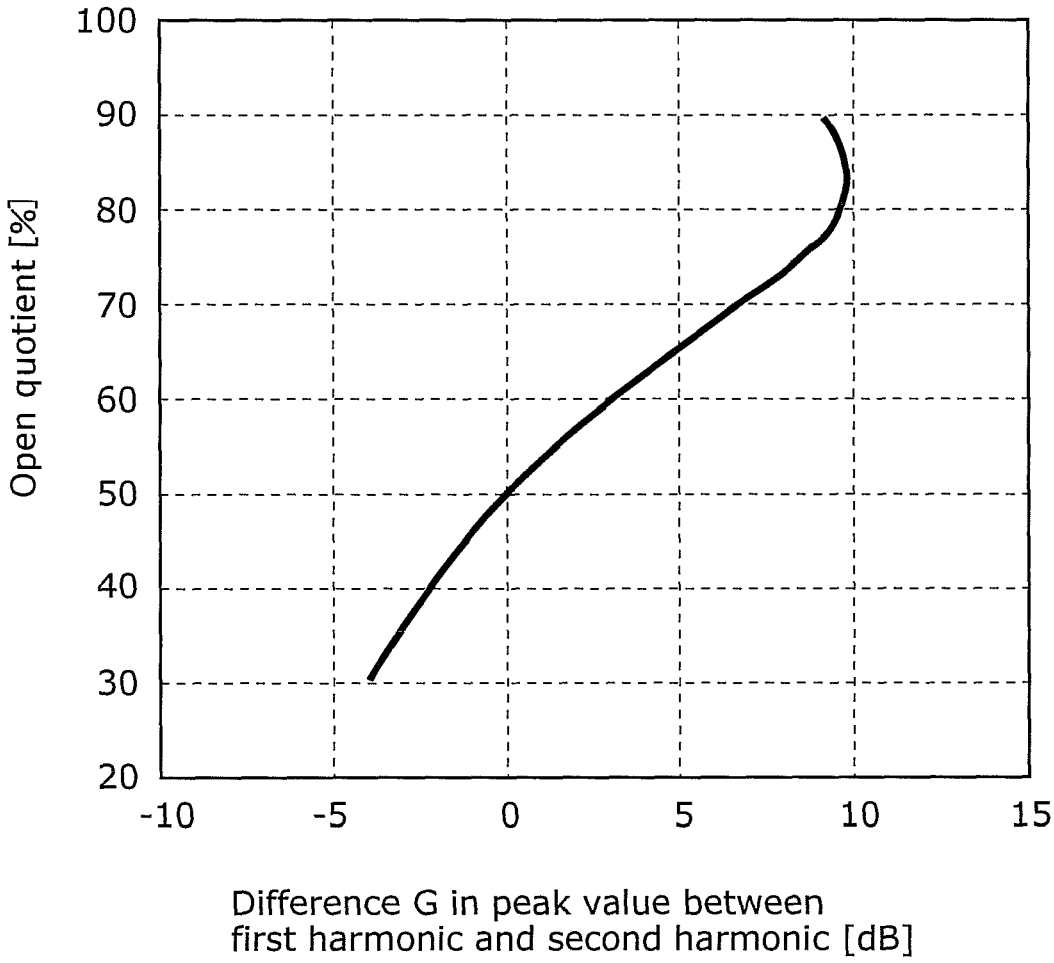
FIG. 28 illustrates open quotients and level differences in logarithmic value between the first harmonic the second harmonic in a sound source spectrum.

The harmonic component generating unit 402 converts the n-th harmonic level H(n) calculated at Step S801 into another level of harmonic based on an input target open quotient (Step S802). The details of the conversion method will be described below. As described with reference to FIG. 1, a lower open quotient (OQ) can increase the degree of tension of vocal folds, and a higher OQ can decrease the degree of tension of vocal folds. Here, FIG. 28 illustrates a relationship between the open quotient and a ratio between the first harmonic level and the second harmonic level. The vertical axis indicates the open quotient, and the horizontal axis indicates the ratio between the first harmonic level and the second harmonic level. Since the horizontal axis is represented by the logarithm, the indicated values are obtained by subtracting logarithmic values of the second harmonic level from logarithmic values of the first harmonic level. Assuming that each of the values (i) obtained by subtracting the logarithmic values of the second harmonic level from the logarithmic values of the first harmonic level and (ii) corresponding to a target open quotient is G (OQ), the resulting first harmonic level F(F0) is represented by Equation 16. In other words, the harmonic component generating unit 402 converts the first harmonic level F(F0) in accordance with Equation 16.

$$F(F0)=F(2F0)*G(OQ) \quad \text{[Equation 16]}$$

The spectral intensity between harmonics can be calculated using interpolation as described in Embodiment 1.

The spectrum combining unit 205 combines the sound source spectrum generated at Step S802 with the input sound source spectrum calculated at Step S105 at the boundary frequency (Fb) (Step S803). More specifically, the spectrum calculated at Step S802 is used in the frequency range equal to or lower than the boundary frequency (Fb). Furthermore, an input sound source spectrum in a frequency range equal to or lower than the boundary frequency (Fb) among the input sound source spectrums calculated at Step S105 is used in the frequency range larger than the boundary frequency (Fb). The boundary frequency (Fb) can be determined in the same method as that of Embodiment 1. Furthermore, the spectrums may be combined in the same method as that of Embodiment 1.

The inverse Fourier transform unit 107 inverse-Fourier-transforms the sound source spectrum obtained after the combining at Step S803 into a time domain, and generates one cycle of a time waveform (Step S804).

The sound source waveform generating unit 108 sets one cycle of the time waveform generated at Step S804 to the position of the fundamental period calculated using the target fundamental frequency. With the setting process, one cycle of the sound source waveform is generated. With the repetition of the setting process for each fundamental period, the sound source waveform obtained by converting the fundamental frequency of the input speech waveform can be generated (Step S805).

The synthesis unit 109 synthesizes the sound source waveform generated by the sound source waveform generating unit 108 and the vocal tract information separated by the vocal tract sound source separating unit 101*b* to generate a synthesized sound source waveform (Step S806). The speech synthesis method is the same as that of Embodiment 1.

(Advantage)

With the configuration, the open quotient that is a feature of a sound source can be freely changed by controlling the first harmonic level based on an input target open quotient, while maintaining the naturalness of the sound source waveform.

Figure 29:
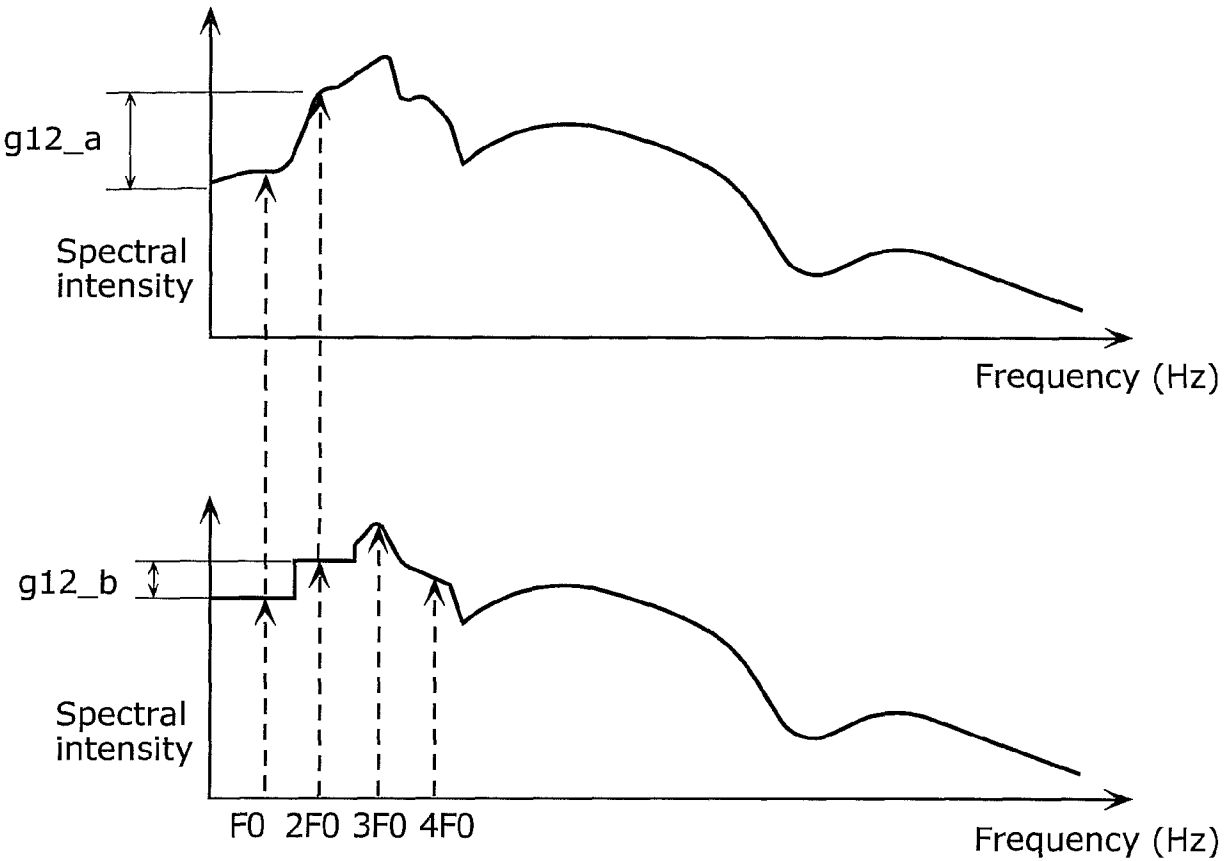
FIG. 29 illustrates examples of sound source spectrums before and after the transformation according to Embodiment 3.

FIG. 29 illustrates sound source spectrums before and after the transformation according to Embodiment 3. (a) in FIG. 29 is a graph indicating a spectral envelope of an input sound source spectrum. (b) in FIG. 29 is a graph indicating a spectral envelope of a sound source spectrum after the transformation according to Embodiment 3. In each of the graphs, the horizontal axis indicates the frequency, and the vertical axis indicates the spectral intensity of the sound source spectrum. Furthermore, each up-pointing dashed arrow indicates a position of a harmonic. Furthermore, the fundamental frequency is indicated by F0.

The level difference between the first harmonic and the second harmonic (g12_a, g12_b) can be changed without changing the second harmonic 2F0 and the spectral envelope in the high frequency range before and after the transformation. Thus, the open quotient can be freely changed, and only the degree of tension of vocal folds can be changed.

Although the voice quality conversion apparatus and the pitch conversion apparatus according to the present invention are described according to Embodiments, the present invention is not limited to these Embodiments.

For example, each of the apparatuses described in Embodiments 1 to 3 can be implemented by a computer.

Figure 30:
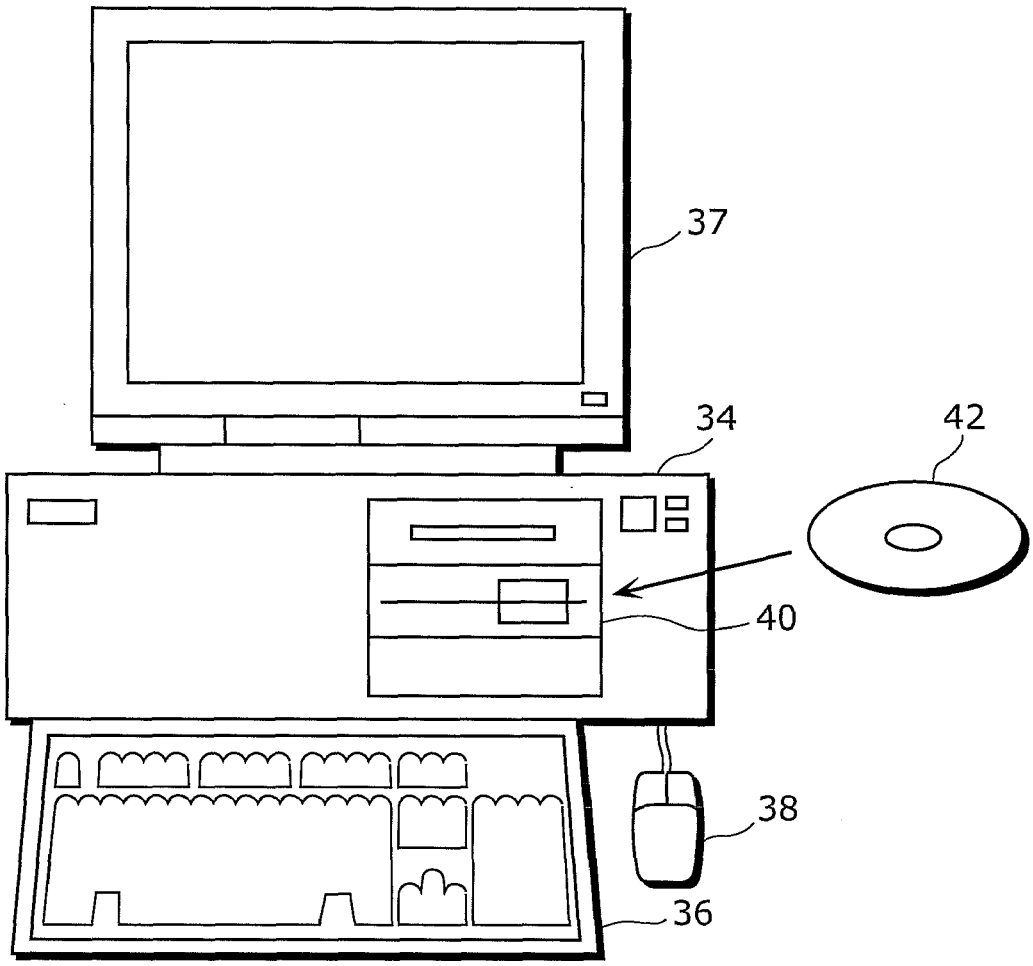
FIG. 30 illustrates an outline view of one of the voice quality conversion apparatus and the pitch conversion apparatus.

FIG. 30 illustrates an outline view of each of the apparatuses. The apparatuses include: a computer 34; a keyboard 36 and a mouse 38 for instructing the computer 34; a display 37 for presenting information, such as results of computations made by the computer 34; a Compact Disc-Read Only Memory (CD-ROM) device 40 for reading a computer program executed by the computer 34; and a communication modem (not illustrated).

The computer program for converting voice quality or the computer program for converting a pitch is stored in a computer-readable CD-ROM 42, and is read by the CD-ROM device 40. Alternatively, the computer program is read by the communication modem via a computer network.

Figure 31:
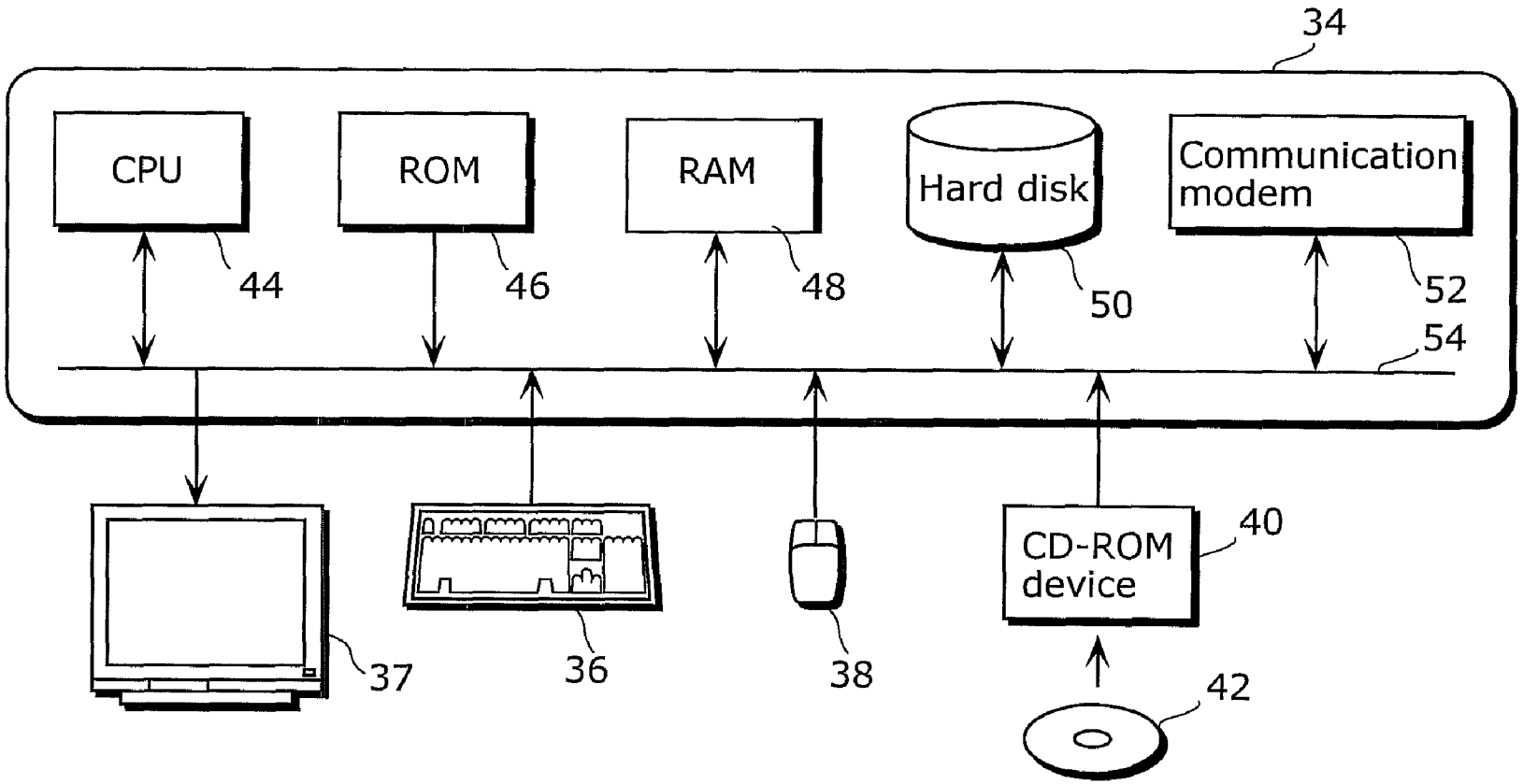
FIG. 31 is a block diagram illustrating a hardware configuration of one of the voice quality conversion apparatus and the pitch conversion apparatus.

FIG. 31 is a block diagram illustrating a hardware configuration of each of the apparatuses. The computer 34 includes a Central Processing Unit (CPU) 44, a Read Only Memory (ROM) 46, a Random Access Memory (RAM) 48, a hard disk 50, a communication modem 52, and a bus 54.

The CPU 44 executes a computer program read through the CD-ROM device 40 or the communication modem 52. The ROM 46 stores a computer program and data that are necessary for operating the computer 34. The RAM 48 stores data including a parameter for executing a computer program. The hard disk 50 stores a computer program, data, and others. The communication modem 52 communicates with other computers via the computer network. The bus 54 connects the CPU 44, the ROM 46, the RAM 48, the hard disk 50, the communication modem 52, the display 37, the keyboard 36, the mouse 38, and the CD-ROM device 40 to one another.

The RAM 48 or the hard disk 50 stores a computer program. The CPU 44 operates in accordance with a computer program, so that each of the apparatuses can implement the function. Here, the computer program includes a plurality of instruction codes indicating instructions for a computer so as to implement a predetermined function.

Alternatively, the RAM 48 or the hard disk 50 stores various data, such as intermediate data to be used when executing a computer program.

Furthermore, a part or all of the constituent elements included in each of the apparatuses may be configured from a single System-Large-Scale Integration (LSI). The System-LSI is a super-multi-function LSI manufactured by integrating constituent units on one chip, and is specifically a computer system configured from a microprocessor, a ROM, and a RAM. The RAM stores a computer program. The System-LSI achieves its function through the microprocessor's operation according to a computer program.

Furthermore, a part or all of the constituent elements included in each of the apparatuses may be configured as an IC card which can be attached and detached from the apparatus or as a stand-alone module. The IC card or the module is a computer system configured from a microprocessor, a ROM, a RAM, and others. The IC card or the module may also be included in the aforementioned super-multi-function LSI. The IC card or the module achieves its function through the microprocessor's operation according to the computer program. The IC card or the module may also be implemented to be tamper-resistant.

Furthermore, the present invention may be implemented as the methods described above. Furthermore, these methods may be computer programs implemented by a computer program, and digital signals included in the computer program.

Furthermore, the present invention may be implemented as a computer-readable recording medium on which the computer program or the digital signal is recorded, such as a flexible disk unit, a hard disk, a CD-ROM, a MO, a DVD, a DVD-ROM, a DVD-RAM, a Blu-ray Disc® (BD), and a semiconductor memory. Furthermore, the present invention may be implemented as the digital signal recorded on these recording media.

Furthermore, the present invention may also be realized by the transmission of the aforementioned computer program or digital signal via a telecommunication line, a wireless or wired communication line, a network represented by the Internet, data broadcasting, and so on.

Furthermore, the present invention may also be a computer system including a microprocessor and a memory, in which the memory may store the aforementioned computer program and the microprocessor may operate according to the computer program.

Furthermore, by transferring the program or the digital signal recorded onto the aforementioned recording media, or by transferring the program or digital signal via the aforementioned network and others, execution using another independent computer system is also made possible.

Furthermore, Embodiments and modifications may be combined.

Embodiments disclosed this time are merely examples for all aspects and do not limit the present invention. A scope of the present invention is recited by claims not by the above description, and all modifications are intended to be included within the scope of the present invention with meanings equivalent to the claims and without departing from the claims.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

Each of the voice quality conversion apparatus and the pitch conversion apparatus according to the present invention has a function of converting the voice quality with high quality by transforming features of the sound source, and are useful as a user interface device, an entertainment apparatus, and others for which various kinds of voice quality are necessary. Furthermore, the present invention is applicable to a voice changer and others in speech communication using a mobile telephone, for example.

What is claimed is:

1. A voice quality conversion apparatus that converts voice quality of an input speech, said apparatus comprising:

a fundamental frequency converting unit configured to calculate a weighted sum of a fundamental frequency of an input sound source waveform and a fundamental frequency of a target sound source waveform at a predetermined conversion ratio as a resulting fundamental frequency, the input sound source waveform representing sound source information of an input speech waveform, and the target sound source waveform representing sound source information of a target speech waveform;

a low-frequency spectrum calculating unit configured to calculate a low-frequency sound source spectrum by mixing a level of a harmonic of the input sound source waveform and a level of a harmonic of the target sound source waveform at the predetermined conversion ratio for each order of harmonics including fundamental, using an input sound source spectrum and a target sound source spectrum in a frequency range equal to or lower than a boundary frequency determined depending on the resulting fundamental frequency calculated by said fundamental frequency converting unit, the low-frequency sound source spectrum having levels of harmonics in which the resulting fundamental frequency is set to a fundamental frequency of the low-frequency sound source spectrum, the input sound source spectrum being a sound source spectrum of an input speech, and the target sound source spectrum being a sound source spectrum of a target speech;

a high-frequency spectrum calculating unit configured to calculate a high-frequency sound source spectrum by mixing the input sound source spectrum and the target sound source spectrum at the predetermined conversion ratio in a frequency range larger than the boundary frequency;

a spectrum combining unit configured to combine the low-frequency sound source spectrum with the high-frequency sound source spectrum at the boundary frequency to generate a sound source spectrum for an entire frequency range; and a synthesis unit configured to generate a synthesized speech waveform using the sound source spectrum for the entire frequency range.

2. The voice quality conversion apparatus according to claim 1, wherein the boundary frequency is set higher as the resulting fundamental frequency is higher.

3. The voice quality conversion apparatus according to claim 2, wherein the boundary frequency is a frequency corresponding to a critical bandwidth matching a value of the resulting fundamental frequency, the critical bandwidth being a frequency bandwidth (i) which varies depending on a frequency and (ii) in which two sounds at different frequencies in a same frequency range are perceived by a human ear as a single sound obtained by adding intensities of the two sounds.

4. The voice quality conversion apparatus according to claim 1, wherein said low-frequency spectrum calculating unit is further configured to hold rule data for determining a boundary frequency using a fundamental frequency, and to determine, using the rule data, a boundary frequency corresponding to the resulting fundamental frequency calculated by said fundamental frequency converting unit.

5. The voice quality conversion apparatus according to claim 4, wherein the rule data indicates a relationship between a frequency and a critical bandwidth, and said low-frequency spectrum calculating unit is further configured to determine, as a boundary frequency and using the rule data, a frequency corresponding to a critical bandwidth matching a value of the resulting fundamental frequency calculated by said fundamental frequency converting unit.

6. The voice quality conversion apparatus according to claim 1, wherein said low-frequency spectrum calculating unit is further configured to calculate a level of a harmonic by mixing the level of the harmonic of the input sound source waveform and the level of the harmonic of the target sound source waveform at the predetermined conversion ratio for each order of the harmonics including the fundamental in the frequency range equal to or lower than the boundary frequency, and to calculate the low-frequency sound source spectrum by determining the calculated level of the harmonic as the level of the harmonic of the low-frequency sound source spectrum at a frequency of a harmonic calculated using the resulting fundamental frequency.

7. The voice quality conversion apparatus according to claim 1, wherein said low-frequency spectrum calculating unit is further configured to calculate the low-frequency sound source spectrum in the frequency range equal to or lower than the boundary frequency by interpolating a level of the low-frequency sound source spectrum at a first frequency other than a frequency of a harmonic calculated using the resulting fundamental frequency, using a level of a harmonic at a frequency adjacent to the first frequency in the low-frequency sound source spectrum.

8. The voice quality conversion apparatus according to claim 1, wherein said low-frequency spectrum calculating unit is further configured to calculate the low-frequency sound source spectrum in the frequency range equal to or lower than the boundary frequency by transforming the input sound source spectrum and the target sound source spectrum into another input sound source spectrum and an output sound source spectrum, respectively, so that each of the fundamental frequency of the input sound source spectrum and the fundamental frequency of the target sound source spectrum matches the resulting fundamental frequency, and mixing the other input sound source spectrum and the output sound source spectrum at the predetermined conversion ratio.

9. The voice quality conversion apparatus according to claim 1, wherein said high-frequency spectrum calculating unit is configured to calculate the high-frequency sound source spectrum by calculating a weighted sum of a spectral envelope of the input sound source spectrum and a spectral envelope of the target sound source spectrum at the predetermined conversion ratio in the frequency range larger than the boundary frequency.

10. The voice quality conversion apparatus according to claim 9, further comprising a sound source spectrum calculating unit configured to calculate an input sound source spectrum and a target sound source spectrum using a waveform obtained by multiplying a first window function by the input sound source waveform and a waveform obtained by multiplying a second window function by the target sound source waveform, respectively, and to calculate the spectral envelope of the input sound source spectrum and the spectral envelope of the target sound source spectrum using the calculated input sound source spectrum and the calculated target sound source spectrum, respectively.

11. The voice quality conversion apparatus according to claim 10, wherein the first window function is a window function having a length that is double a fundamental period of the input sound source waveform, and the second window function is a window function having a length that is double a fundamental period of the target sound source waveform.

12. The voice quality conversion apparatus according to claim 1, wherein said high-frequency spectrum calculating unit is configured to calculate the high-frequency sound source spectrum in the frequency range larger than the boundary frequency by calculating a difference between a spectral tilt of the input sound source spectrum and a spectral tilt of the target sound source spectrum, and transforming the input sound source spectrum using the calculated difference.

13. The voice quality conversion apparatus according to claim 1, wherein the input speech waveform and the target speech waveform are speech waveforms of a same phoneme.

14. The voice quality conversion apparatus according to claim 13, wherein the input speech waveform and the target speech waveform are the speech waveforms of the same phoneme and at a same temporal position within the same phoneme.

15. The voice quality conversion apparatus according to claim 1, further comprising a fundamental frequency calculating unit configured to extract feature points repeatedly appearing at fundamental period intervals of each of the input sound source waveform and the target sound source waveform, and to calculate the fundamental frequency of the input sound source waveform and the fundamental frequency of the target sound source waveform using corresponding ones of the fundamental period intervals of the extracted feature points.

16. The voice quality conversion apparatus according to claim 15, wherein each of the feature points is a glottal closure instant (GCI).

17. A voice quality conversion method of converting voice quality of an input speech, said method comprising:

calculating a weighted sum of a fundamental frequency of an input sound source waveform and a fundamental frequency of a target sound source waveform at a predetermined conversion ratio as a resulting fundamental frequency, the input sound source waveform representing sound source information of an input speech waveform, and the target sound source waveform representing sound source information of a target speech waveform;

calculating a low-frequency sound source spectrum by mixing a level of a harmonic of the input sound source waveform and a level of a harmonic of the target sound source waveform at the predetermined conversion ratio for each order of harmonics including fundamental, using an input sound source spectrum and a target sound source spectrum in a frequency range equal to or lower than a boundary frequency corresponding to the resulting fundamental frequency calculated in said calculating a weighted sum, the low-frequency sound source spectrum having levels of harmonics in which the resulting fundamental frequency is set to a fundamental frequency of the low-frequency sound source spectrum, the input sound source spectrum being a sound source spectrum of an input speech, and the target sound source spectrum being a sound source spectrum of a target speech;

calculating a high-frequency sound source spectrum by mixing the input sound source spectrum and the target sound source spectrum at the predetermined conversion ratio in a frequency range larger than the boundary frequency;

combining the low-frequency sound source spectrum with the high-frequency sound source spectrum at the boundary frequency to generate a sound source spectrum for an entire frequency range; and generating a synthesized speech waveform using the sound source spectrum for the entire frequency range.

18. A program for converting voice quality of an input speech recorded on a non-transitory computer-readable recording medium, said program causing a computer to execute:

calculating a weighted sum of a fundamental frequency of an input sound source waveform and a fundamental frequency of a target sound source waveform at a predetermined conversion ratio as a resulting fundamental frequency, the input sound source waveform representing sound source information of an input speech waveform, and the target sound source waveform representing sound source information of a target speech waveform;

calculating a low-frequency sound source spectrum by mixing a level of a harmonic of the input sound source waveform and a level of a harmonic of the target sound source waveform at the predetermined conversion ratio for each order of harmonics including fundamental, using an input sound source spectrum and a target sound source spectrum in a frequency range equal to or lower than a boundary frequency corresponding to the resulting fundamental frequency calculated in the calculating a weighted sum, the low-frequency sound source spectrum having levels of harmonics in which the resulting fundamental frequency is set to a fundamental frequency of the low-frequency sound source spectrum, the input sound source spectrum being a sound source spectrum of an input speech, and the target sound source spectrum being a sound source spectrum of a target speech;

calculating a high-frequency sound source spectrum by mixing the input sound source spectrum and the target sound source spectrum at the predetermined conversion ratio in a frequency range larger than the boundary frequency;

combining the low-frequency sound source spectrum with the high-frequency sound source spectrum at the boundary frequency to generate a sound source spectrum for an entire frequency range; and generating a synthesized speech waveform using the sound source spectrum for the entire frequency range.

* * * * *